US007106995B2

(12) United States Patent
Nagai et al.

(10) Patent No.: US 7,106,995 B2
(45) Date of Patent: Sep. 12, 2006

(54) DEVELOPER CARTRIDGE CONTAINER, DEVELOPER CARTRIDGE, IMAGE FORMING UNIT, RECYCLING METHOD OF DEVELOPER CARTRIDGE CONTAINER, AND RECYCLING METHOD OF DEVELOPER CARTRIDGE

(75) Inventors: Takanori Nagai, Kanagawa (JP); Hideo Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/777,214

(22) Filed: Feb. 13, 2004

(65) Prior Publication Data

US 2005/0025528 A1 Feb. 3, 2005

(30) Foreign Application Priority Data

Feb. 14, 2003 (JP) ..... P2003-036014
Oct. 15, 2003 (JP) ..... P2003-355411

(51) Int. Cl.
*G03G 15/08* (2006.01)

(52) U.S. Cl. ..... 399/258; 399/109

(58) Field of Classification Search ..... 399/262, 399/263, 109, 258, 260
See application file for complete search history.

(56) References Cited

U.S. PATENT DOCUMENTS

| | | | | |
|---|---|---|---|---|
| 5,260,750 | A * | 11/1993 | Ishida et al. | 399/262 |
| 5,305,064 | A * | 4/1994 | Trott et al. | 399/258 |
| 5,828,935 | A * | 10/1998 | Tatsumi et al. | 399/260 |
| 5,890,040 | A * | 3/1999 | Matsuoka et al. | 399/262 |
| 5,895,149 | A * | 4/1999 | Weed | 399/262 |
| 6,654,577 | B1 * | 11/2003 | Hooper | 399/109 |
| 2002/0102113 | A1 * | 8/2002 | Kusano et al. | 399/262 |

FOREIGN PATENT DOCUMENTS

| | | |
|---|---|---|
| JP | 09-269658 | 10/1997 |
| JP | 2002-006603 | 1/2002 |

* cited by examiner

*Primary Examiner*—Susan Lee
(74) *Attorney, Agent, or Firm*—Morgan, Lewis & Bockius LLP

(57) ABSTRACT

A developer cartridge container including a container body having a cylindrical body formed with an opening at one end and a bottom wall member provided on the other end opposite from the one end, an resilient thin wall container to be accommodated in the container body, and a closing lid having a developer discharge port capable of being attached to and detached from the container body and a mounting portion of a coupler for closing the opening of the container body and an opening of the resilient thin wall container in a state of being mounted to the container body.

17 Claims, 27 Drawing Sheets

DEVELOPER CARTRIDGE CONTAINER, DEVELOPER CARTRIDGE, IMAGE FORMING UNIT, RECYCLING METHOD OF DEVELOPER CARTRIDGE CONTAINER, AND RECYCLING METHOD OF DEVELOPER CARTRIDGE

BACKGROUND OF THE INVENTION

1. Field of the Invention

The present invention relates to a developer cartridge container used for an electrophotographic image forming unit and an image forming method where by an electrostatic latent image is formed on a photoreceptor (first image carrier) by electrostatic charge and light exposure, the electrostatic latent image is developed to a toner image, and the toner image is transferred to a second image carrier, such as an image recording sheet or an intermediate transfer material, a developer cartridge using the developer cartridge container, an image forming unit using the developer cartridge container or the developer cartridge, and a recycling method of the developer cartridge container and the developer cartridge.

The image forming unit of the present invention is used in a copying machine, a printer, or a facsimile.

2 . Description of the Related Art

In the related art, an image forming unit in which a cartridge mounting member for detachably mounting a developer cartridge containing supplemental developer therein is provided in the image forming unit for replenishing developer to the developer container of the developing device is known. In such image forming unit, developer is supplied from the developer cartridge as the developer in the developer container of the developing device is consumed and thus decreased.

The developer cartridge conventionally known is disclosed in JP-A-2002-6603.

This Patent Document 1 discloses a developer cartridge having a feeding member for feeding toner contained in a container body 301A in the direction toward a toner supply opening 301*g* provided along the entire length of the developer cartridge container.

In JP-A-2002-6603, the feeding member is provided along the entire length of the developer cartridge container, and hence the structure of the entire cartridge container is complicated. In addition, when dividing the developer cartridge container into an upper frame and a lower frame, it is divided along the length thereof. Therefore, both of the divided upper frame and lower frame cannot be reduced in size (the maximum dimensions) so much, and thus a large storage space is required when storing them on a flat surface side-by-side in the divided state.

Recently, recycling of various devices is carried out for reducing disposal of radioactive waste and preventing environmental destruction. In the technological field of the image forming unit, the recycling technology for various components is being developed.

In order to recycle the developer cartridges used in the electrophotographic image forming unit for the copying machine, the printer, and the facsimile easily at low cost, it is necessary to configure the developer cartridge container so as to be capable of being recycled easily at low cost. In order to do so, it is necessary to configure the developer cartridge container in such a manner that components thereof can easily be assembled and disassembled, and the used components can easily be washed for recycling.

When considering washing of the developer cartridge container for recycling (reuse), washing operation may be facilitated, when it can be divided into parts having easy-to-wash configurations, when the divided parts are not of complex shapes, but of easy-to-wash configurations (simple shapes), and when the number of divided parts is small. The developer cartridge container is inevitably provided with a coupler mounting portion for mounting a coupler for transmitting a rotational force to a mixing member for mixing developer in the container and a developer discharge port for supplying the developer in the container to the developing device. The part formed with the coupler mounting portion or the developer discharge port does not assume a simple shape, but assumes a complex shape.

When dividing the developer cartridge container, and when the part formed with the coupler mounting portion and the part formed with the developer discharge port are divided into the separate parts, those parts assume relatively complex shapes, and thus two parts of relatively complex shapes are generated. Since the part of complex shape requires longer time for washing, providing the coupler mounting portion and the developer discharge port on a single part is more convenient for washing operation for recycling (reuse) as long as the shape of the part does not become too much complicated even when the coupler mounting portion and the developer discharge port are provided in a single part.

SUMMARY OF THE INVENTION

In view of such circumstances, technical objects of the present invention are as shown in (001) and (002).

(001) To design the developer cartridge container used in the image forming unit so as to be divided into parts having easy-to-wash configurations for recycling (reuse).

(002) To facilitate washing operation for the used parts when recycling the developer cartridge to be used in the image forming unit.

The present invention, in which the problems described above are solved, will be described below. The components in the invention are designated by reference numerals of the components in the embodiments in parentheses in order to facilitate comparison with the components in the embodiments described later. The reason why the invention is described with reference numbers corresponding to the embodiment described later is to facilitate understanding of the invention, but not to limit the scope of the present invention to the embodiments.

In order to solve the problem described above, a developer cartridge container according to the first aspect of the invention is characterized by the following components (A01) and (A02).

(A01) A container body including a cylindrical body having an opening at one end and a bottom wall member provided at the other end opposite from the one end, the cylindrical body and the bottom wall member defining a developer storage chamber having the opening for filling the developer at one end.

(A02) A closing lid including a detachable portion capable of being attached to and detached from the container body and a developer discharge port for closing the opening of the developer storage chamber in a state of being attached to the container body.

In the first aspect of the invention, the "detachable portion capable of being attached to and detached from the container body" may be configured to be capable of being attached to and detached from the container body indirectly with the intermediary of a separate member, or directly without the intermediary of the separate member.

In the developer cartridge container according to the first aspect of the invention in this arrangement, the container body having the cylindrical body formed with the opening at one end and the bottom wall member provided on the other end opposite from one end is defined in the interior thereof with the developer storage chamber having the opening at one end.

The closing lid is detachably attached to the container body via the detachable portion, and closes the opening of the developer storage chamber of the container body in the attached state. Therefore, the opening is closed by the closing lid after the developer storage chamber is filled with the developer via the opening of the developer storage chamber.

The developer in the developer storage chamber can be discharged out through the developer discharge port of the closing lid.

According to the first aspect of the invention, since the developer discharge port is provided in the closing lid, the structure of the container body may be simplified. Therefore, when recycling (reusing), the container body can be washed easily. In addition, since the closing lid may be configured to be smaller with respect to the container body, the washing operation is easy. Therefore, working efficiency for recycling is improved.

In the developer cartridge container according to the first aspect of the invention, the following components (A03) may be included.

(A03) The closing lid including a cylindrical wall formed with a detachable portion capable of being attached to and detached from the container body, an end wall connected to an outer end of the cylindrical wall opposite from the container body, and a developer discharge port provided at the outer end of the cylindrical wall or the outer peripheral surface of the end wall, wherein the closing lid closes the opening of the developer storage chamber in the state of being attached to the container body.

In the developer cartridge container according to the first aspect of the invention including the component (A03), the end wall is connected to the outer end of the cylindrical wall of the closing lid opposite from the container body, so that the opening of the developer storage chamber can be closed by the end wall.

The developer in the developer storage chamber can be discharged out through the developer discharge port formed on the outer end of the cylindrical wall or on the outer peripheral surface of the end wall.

In the developer cartridge container according to the first aspect of the invention including the component (A03), the following components (A04) may be included.

(A04) The closing lid having a coupler mounting portion provided at the center of the end wall. In the developer cartridge container according to the first aspect of the invention including the component (A04), a coupler for transmitting a rotational force to a mixing member for mixing the developer in the developer storage chamber may be provided on the coupler mounting portion provided at the center of the end wall. According to the first aspect of the invention, since the coupler mounting portion and the developer discharge port are provided in the closing lid, the structure of the container body may be simplified. Therefore, when recycling (reusing), the container body can easily be washed. When washing the closing lid (13), it may be performed in a state in which the coupler is detached from or attached to the closing lid.

In the developer cartridge container according to the first aspect of the invention, the following components (A05) and (A06) may be included.

(A05) The closing lid formed with a cylindrical developer discharge tube having an axis parallel with an axis of the cylindrical body of the container body, (A06) The developer discharge port formed at the outer end of the developer discharge tube.

The developer cartridge container according to the first aspect of the invention including the components (A05) and (A06), the developer in the container body is discharged from the developer discharge port formed at the outer end thereof through the cylindrical developer discharge tube provided in the closing lid.

In the developer cartridge container according to the first aspect of the invention including the component (A03), the following components (A07) and (A06) may be included.

(A07) The cylindrical wall formed with the cylindrical developer discharge tube having an axis parallel with the axis of the cylinder body of the container body.

(A06) The developer discharge port formed at the outer end of the developer discharge tube.

In the developer cartridge container according to the first aspect of the invention including the components (A07) and (A06), the developer in the container body is discharged from the developer discharge port formed at the outer end thereof through the cylindrical developer discharge tube formed on the cylindrical wall of the closing lid.

In the developer cartridge container according to the first aspect of the invention, the following component (A08) may be included.

(A08) The container body formed integrally with the cylinder body and the bottom wall member.

In the developer cartridge container including the component (A08), since the cylindrical body and the bottom wall member, which are the components of the container body, are integrally formed, the number of components may be reduced.

In the developer cartridge container according to the first aspect of the invention, the following component (A09) may be included.

(A09) The container body formed integrally with the cylinder body and the bottom wall member.

In the developer cartridge container including the component (A09), since the cylindrical body and the bottom wall member, which are the components of the container body, are provided so as to be detachable, the cylindrical body and the bottom wall member may be washed in the detached state for recycling (reuse). The detached cylindrical body and the bottom wall member are small and simple in shape, the washing operation can easily be performed.

In the developer cartridge container according to the first aspect of the invention, or in the developer cartridge container including the component (A08) or the component (A09), the following component (A010) may be included.

(A010) The container body in which a handle that the operator can grasp is provided on the outer surface of the bottom wall member of the container body and the bottom wall member and the handle are integrally formed.

In the developer cartridge container including the component (A010), since the handle is integrally formed on the bottom wall member, the operator can hold the handle when performing the operation handling the developer cartridge container.

In the developer cartridge container according to the first aspect of the invention including any one of the components from (A08) to (A010), the following component (A011) may be included.

(A011) A resilient thin wall container for storing the developer formed of resilient thin wall material detachably accommodated in the container body and formed with an opening to be disposed inside the opening of the container body.

In the developer cartridge container according to the first aspect of the invention including the component (A011), the resilient thin wall container for storing the developer formed of a resilient thin wall material includes the opening to be disposed inside the opening of the container body, and detachably accommodated in the container body. Therefore, the container body is prevented from being stained with the developer. When the extent of stain on the container body is small, the washing operation of the container body for reusing the container body is easy.

In the developer cartridge container including the component (A011), the following component (A012) and (A013) may be included.

(A012) A cylindrical connecting member including a container-body-side connecting portions having a cylindrical insertion member to be inserted from the opening of the container body into the container body and to be detachably connected to the container body, and a closing-lid-side connecting portion to be connected to the detachable portion of the closing lid.

(A013) The resilient thin wall container formed of resilient thin wall material having the opening to be fixed in a state of being adhered tightly to the outer peripheral surface of the cylindrical insertion portion of the cylindrical connecting member.

The cylindrical insertion member is usable as the container-body-side connecting member and in this case, it serves also as the container-body-side connecting member.

In the developer cartridge container including the components (A012) and (A013), since the closing lid and the cylindrical connecting member being detachable to the detachable portion of the cylindrical wall are separable, and the opening of the resilient thin wall container is mounted to the cylindrical insertion member (14*a*) provided on the cylindrical connecting member, the cylindrical connecting member and the resilient thin wall container can be disconnected from the closing lid and the container body.

The closing lid and the container body can be washed and recycled (reused). When recycling, they can be washed by disconnected into the container body and the closing lid, and in this case, since the parts to be washed are small, they can be washed easily.

Since the cylindrical connecting member and the resilient thin wall container are parts, which are simple in structure and at low cost, they may be configured to be thrown out, or may be recycled as material for manufacturing different parts. When the opening of the resilient thin wall container is detachably mounted to the cylindrical connecting member, the cylindrical connecting member may be washed for recycling (reuse).

In the developer cartridge container including the components (A012) and (A013), the following component (A012') may be included.

(A012') The cylindrical connecting member in which a connecting portion of one of the container-body-side connecting portions and the closing-lid-side connecting portion is configured so as to be broken when disconnected after connected to the container body or the closing lid so that it cannot be reused.

In a developer cartridge including the component (A012'), a connection portion of one of the container body side connecting portions and the closing lid side connecting portion of the cylindrical connecting member is configured so as to be broken when disconnected after connected to the container body or the closing lid so that it cannot be reused. Therefore, when the spent developer cartridge is reused, the cylindrical connecting member cannot be reused. Therefore, the cylindrical connecting member has to be replaced with a new one.

In the developer cartridge container including the component (A011), the following components (A014)–(A016) may be included.

(A014) The cylindrical wall having the cylindrical insertion portion to be inserted into the interior of the container body from the opening of the container body.

(A015) A resilient thin wall container including the opening to be attached in a tightly adhered state to the outer peripheral surface of the cylindrical insertion portion of the cylindrical wall, the resilient thin wall container being accommodated in the container body.

(A016) The closing lid formed with an openable-closable filling port for filling developer into the resilient thin wall container attached to the cylindrical insertion portion of the cylindrical wall.

In the developer cartridge container (11) including the components (A014)–(A016), the resilient thin wall container can be attached to the outer peripheral surface of the cylindrical insertion portion of the cylindrical wall of the closing lid with the opening tightly adhered thereto. The container body and the closing lid may be communicated in a state in which the cylindrical wall of the closing lid and the resilient thin wall container attached to the cylindrical wall are accommodated in the container body. In this state, the developer can be filled in the resilient thin wall container from the openable-closable filling port provided in the closing lid.

When recycling the developer cartridge container, the resilient thin wall container which is most stained with the developer may be configured to be separable from the closing lid, the container body, or the like to throw out, or may be recycled as material for manufacturing different parts. The closing lid and the container body may be washed and recycled (reused).

In the developer cartridge container including the component (A011), the following component (A017) and (A018) may be included.

(A017) The resilient thin wall container including the opening to be attached to the opening of the container body so as to be detachable and in a tightly adhered state, the resilient thin wall container being accommodated in the container body.

(A018) The opening fixing members for fixing the opening of the resilient thin wall container to the opening of the container body.

In the developer cartridge container including the components (A017) and (A018), the opening fixing members fix the opening of the resilient thin wall container (15) to the opening of the container body. When the developer cartridge container is spent, the opening of the resilient thin wall container and the opening fixing members may be disconnected from the opening of the container body to throw out, or may be recycled as material for manufacturing different parts. When the opening fixing members are still reusable, they may be reused.

In the developer cartridge container including the components (A017) and (A018), the following component (A019) may be included.

(A019) The opening fixing members fixed to the opening of the resilient thin wall container.

In the developer cartridge container including the component (A019), since the opening fixing members are fixed to the opening (15*c*) of the resilient thin wall container, the opening of the resilient thin wall container can be fixed to the container body by fixing the opening fixing member to the container body.

The developer cartridge according to the second aspect of the present invention is characterized by the developer cartridge container of the first aspect of the invention, a coupler for transmitting a rotational force supported by the developer cartridge container a developer mixing member accommodated in the developer cartridge container and connected to the coupler, and a discharge port opening-closing member for opening and closing the developer discharge port provided on the developer cartridge container.

In the developer cartridge according to the second aspect of the invention, since the developer cartridge container according to the first aspect of the invention is employed, recycling operation of the developer cartridge container can be performed easily when recycling the developer cartridge.

The developer cartridge according to the third aspect of the invention is characterized by the following components (A01) and (A020)–(A024).

(A01) A container body including a cylindrical body having an opening at one end and a bottom wall member provided on the other end opposite from the one end, the cylindrical body and the bottom wall member defining a developer storage chamber having the opening for filling developer at one end.

(A020) A closing lid including a detachable portion that can be attached to and detached from the container body, and a cylindrical developer discharge tube extending along an axis of the cylinder of the container body and being formed with a developer discharge port at the outer end thereof, and the closing lid closing the opening of the developer storage chamber in a state of being attached to the container body.

(A021) A coupler for transmitting a rotational force rotatably supported by the closing lid.

(A022) A developer mixing member accommodated in the container body and connected to the coupler.

(A023) A developer discharging auger rotatably accommodated in the cylindrical developer discharge tube.

(A024) A discharge port opening-closing member including a fitting portion to be detachable fitted to the developer discharge port, an auger connecting portion to which the outer end of the developer discharging auger is connected, a shaft projecting outwardly of the developer discharge tube, and a connecting portion for transmitting a rotational force provided at the outer end of the shaft, the discharge port opening-closing member closing the developer discharge port in a state of being fitted to the developer discharge port, opening the developer discharge port in the state of being disconnected from the developer discharge port, and being rotatable integrally with the auger in the disconnected state.

In the third aspect of the invention, the "detachable portion capable of being attached to and detached from the container body" may be configured to be capable of being attached to and detached from the container body indirectly with the intermediary of a separate member, or directly without the intermediary of the separate member.

In the developer cartridge according to the third aspect of the invention including the above-described structure, the closing lid is attached to the container body via the detachable portion so as to be capable of attaching to and detaching from the container body and, in the attached state, closing the opening of the developer storage chamber of the container body. Therefore, the opening is closed by the closing lid after the developer is filed into the developer storage chamber from the opening of the developer storing chamber.

The developer mixing member accommodated in the container body rotates when the coupler for transmitting a rotational force rotatably supported by the closing lid and mixes the developer in the container body.

The developer discharge port at the outer end of the cylindrical developer discharge tube provided in the closing lid is closed when the fitting portion of the discharge port opening-closing member is fitted. The developer discharge port is opened when the fitting portion of the discharge port opening-closing member is disconnected from the developer discharging port so as to be capable of discharging the developer in the developer storage chamber to the outside.

The discharge port opening-closing member having the fitting portion of the discharge port opening-closing member, which is detachably fitted to the developer discharge port, includes a shaft projecting outwardly of the developer discharge tube, and a connecting portion (20*f*) for transmitting a rotational force provided at the outer end of the shaft. The discharge port opening-closing member is rotated by the rotating member connected to the connecting portion for transmitting a rotational force in a state in which the fitting portion of the discharge port opening-closing member is disconnected from the developer discharge port.

The outer end of the developer discharging auger rotatably accommodated in the cylindrical developer discharge tube is connected to the auger connecting portion of the discharge port opening-closing member. When the discharge port opening-closing member is rotated in a state in which the fitting portion of the discharge port opening-closing member is disconnected from the developer discharge port and the developer discharge port is opened, the developer discharging auger in the developer discharge tube rotates, and the developer in the developer storage chamber is discharged from the developer discharge port through the developer discharge tube.

According to the developer cartridge of the third aspect of the invention, the developer discharge port is provided in the closing lid. The coupler for rotating the developer mixing member for mixing the developer in the container body and the discharge port opening-closing member for rotating the developer discharging auger are disposed not on the side of the container body, but on the side of the closing lid. Therefore, since the structure of the container body is simplified, the container body can easily be washed for recycling (reuse). In addition, since the closing lid may be formed into a compact configuration in comparison with the container body, it can be washed easily. Therefore, working efficiency for recycling may be improved.

The developer cartridge of the third aspect of the invention may include the following component (A025).

(A025) The developer discharging auger formed of a coil spring.

In the developer cartridge including the component (A025), the developer discharging auger is formed of the coil spring, and the outer end of the coil spring is connected to the discharge port opening-closing member. When the fitting portion of the discharge port opening-closing member, being fitted to the developer discharge port and hence closing the developer discharge port, is disconnected from the developer discharge port and hence opens the developer discharge port, the coil spring in the developer discharge tube moves outwardly, or extends from the compressed state. At this time, the developer in the developer discharge tube is fluidized and hence its flowing property is improved. Therefore, the developer in the developer discharge tube may be prevented from being cured and hence lowered in flowing property.

The developer cartridge according to the third aspect of the invention may include the following component (A011).

(A011) A resilient thin wall container for storing developer formed of resilient thin wall material detachably accommodated in the container body and having an opening to be disposed inside the opening of the container body.

In the developer cartridge including the component (A011), the resilient thin wall container for storing the developer formed of a resilient thin wall material includes the opening to be disposed inside the opening of the container body, and detachably accommodated in the container body. Therefore, the container body is prevented from being stained with the developer. When the extent of stain on the container body is small, the washing operation of the container body for reusing the container body may be performed easily.

An image forming unit according to the fourth aspect of the invention is characterized in that the developer cartridge container according to the first aspect of the invention or the developer cartridge according to the second or third aspect of the invention is employed.

In the image forming unit according to the third aspect of the invention, since the developer cartridge container according to the first aspect of the invention or the developer cartridge according to the second or the third aspect of the invention is used, the developer cartridge container according to the first aspect of the invention is used. Therefore, the recycling operation of the developer cartridge container may be performed easily when recycling the image forming unit.

A method of recycling a developer cartridge container according to the fifth aspect of the invention including: a container body including a developer storage chamber having an opening at one end; a cylindrical wall having a cylindrical insertion portion to be inserted from the opening; a closing lid including an end wall connected to the outer end opposite from the cylindrical insertion portion of a cylindrical wall and having a coupler mounting portion and an openable and closable filling port, and a developer discharge port, the closing lid closing the opening of the developer storage chamber in a state of being fitted to the container body; a resilient thin wall container having an opening to be attached in a tightly adhered state to the outer peripheral surface of the cylindrical insertion portion of the cylindrical wall and accommodated in the container body; wherein the resilient thin wall container (15) is not reused and the container body and the closing lid are washed and reused.

According to the method of recycling the developer cartridge container of the fifth aspect of the invention including the above-described components, the opening of the resilient thin wall container is attached to the outer peripheral surface of the cylindrical insertion portion of the cylindrical wall of the closing lid in a tightly adhered state, and the container body and the closing lid are detachably connected in a state in which the cylindrical insertion portion and the resilient thin wall container are inserted into the container body. In this state, the developer can be filled into the resilient thin wall container from the filling port.

When recycling the developer cartridge container, the opening of the resilient thin wall container is disconnected from the cylindrical insertion portion of the closing lid. Since the resilient thin wall container used here may be the one being simple in structure and less expensive, it may be thrown out without reusing, or reused as material for manufacturing different parts. The closing lid and the container body are washed and recycled (reused).

A method of recycling a developer cartridge container according to the sixth aspect of the invention including: a container body including a developer storage chamber having an opening at one end; a closing lid including a cylindrical wall formed with a detachable portion capable of being attached to and detached from the container body, an end wall connecting the outer end of the cylindrical wall on the opposite side from the container body and having a coupler mounting portion, and an developer discharge port formed in the cylindrical wall or the end wall, for closing the opening of the developer storage chamber in a state of being attached to the container body; a resilient thin wall container including an opening to be attached to the opening of the container body in a tightly adhered state, the resilient thin wall container being accommodated in the container body, wherein the resilient thin wall container is not reused, and the container body and the closing lid are washed and reused.

In the recycling method of the developer cartridge container according to the sixth aspect of the invention including the above-described components, the developer cartridge container, when it is recycled, is divided into the closing lid having the coupler mounting portion and the developer discharge port and the container body, and each of them are washed and recycled. Since the coupler mounting portion and the developer discharge port are provided in the closing lid, the structure of the container body is simplified. Therefore, the container body can easily be washed when recycling (reusing).

Since the closing lid is formed with the coupler mounting portion and the developer discharge port, the configuration of the closing lid is complicated. However, since it can be provided into a compact configuration in comparison with the container body, the washing operation is not too difficult. Therefore, the working efficiency for recycling is improved.

The resilient thin wall container which tends to be stained much is thrown out without reusing or recycled as material for manufacturing different parts. Therefore, since the resilient thin wall container is not necessary to wash, the working efficiency for recycling is improved.

A method of recycling a developer cartridge container according to the seventh aspect of the invention including: a container body including a developer storage chamber having an opening at one end; a closing lid including a cylindrical wall, an end wall connected to the cylindrical wall and having a coupler mounting portion, a developer discharge port formed in the end wall or the cylindrical wall, and a detachable portion detachable to the container body; a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end; and a resilient thin wall container having an opening to be attached to the outer peripheral surface of the cylindrical insertion portion of the cylindrical connecting member in a tightly adhered state and being accommodated into the container body, wherein the resilient thin wall container is not reused and the container body and the closing lid are washed and reused.

In the method of recycling the developer cartridge container according to the seventh aspect of the invention including the above-described components, the opening of the resilient thin wall container is attached to the outer peripheral surface of the cylindrical insertion portion of the cylindrical connecting member in a tightly adhered state, and the resilient thin wall container is mounted to the container body in a state in which the resilient thin wall container is accommodated in the container body. In this state, the developer is filled from the opening of the resilient thin wall container into the interior thereof. In this state, the closing lid is directly connected to the container body or indirectly via the cylindrical connecting member. In this state, the developer cartridge container is used.

When recycling the developer cartridge container, the cylindrical connecting member to which the resilient thin wall container is mounted is disconnected from the container body. Since the cylindrical connecting member and the resilient thin wall container that can be employed here may be the one which is simple in structure and low in costs, it is thrown out without reusing, or recycled as material for manufacturing different parts. The lid member and the container body are washed and recycled (reused). When the cylindrical connecting member is in the state of reusable, it can be reused.

A method of recycling a developer cartridge container according to the eighth aspect of the invention including: a container body including a developer storage chamber having an opening at one end; a closing lid including a cylindrical wall, an end wall connected to the cylindrical wall and having a coupler mounting portion, a developer discharge port provided on the end wall or the cylindrical wall, and a detachable portion detachable to the container body; a cylindrical connecting member including a container-body-side connecting portion having a cylindrical insertion portion to be inserted from the opening of the container body into the container body and being detachably connected to the container body at one end and a closing-lid-side connecting portion to be connected to the detachable portion of the closing lid at the other end; and a resilient thin wall container having an opening to be attached to the outer peripheral surface of the cylindrical insertion portion of the cylindrical connecting member in a tightly adhered state and to be accommodated in the container body, wherein the spent developer cartridge container is disassembled into the container body, the closing lid, and the cylindrical connecting member to which the resilient thin wall container is mounted, and in that the resilient thin wall container and the cylindrical connecting member are not reused, and the developer cartridge container is formed by assembling the washed container body, the washed closing lid, a new resilient thin wall container, and a new cylindrical connecting member.

In the method of recycling the developer cartridge container according to the eight aspect of the invention, the spent developer cartridge container is disassembled into the container body, the closing lid, and the cylindrical connecting member to which the resilient thin wall container is mounted. The resilient thin wall container and the cylindrical connecting member are not reused. The container body and the closing lid are washed and assembled with a new resilient thin wall container and a new cylindrical connecting member into the developer cartridge container.

Therefore, while the closing lid and the container body are washed and recycled (reused), since the cylindrical connecting member and the resilient thin wall container employed here may be those which are simple in structure and low in costs, they are thrown out without reusing, or recycled as material for manufacturing different parts.

A method of recycling the developer cartridge container according to the ninth aspect of the invention including: a container body including an developer storage chamber having an opening at one end; a closing lid including a cylindrical wall, an end wall connected to the cylindrical wall and having a coupler mounting portion, a developer discharge port provided on the end wall or the cylindrical wall, and a detachable portion detachable to the container body; a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end, a connecting portion of one of the container-body-side connecting portion and the closing-lid-side connecting portion being configured so as to be broken when detached after connected to the container body or the closing lid so that it cannot be reused;

a resilient thin wall container having an opening to be attached to the outer peripheral surface of the cylindrical insertion portion of the cylindrical connecting member in a tightly adhered state, being formed of the same material as the cylindrical connecting member, and accommodated in the container body, wherein the spent developer cartridge container is disassembled into the container body, the lid member, and the cylindrical connecting member to which the resilient thin wall container is mounted, and in that the cylindrical connecting member and the resilient thin wall container, which are broken when disassembled and hence are disabled, are not reused, and the developer cartridge container is formed by assembling the washed container body, the washed closing lid, a new resilient thin wall container, and a new cylindrical connecting member.

In the method of recycling the developer cartridge container according to the ninth aspect of the invention of the present application, one of the connecting portions of the container-body-side connecting portion and the closing-lid-side connecting portion of the cylindrical connecting member is configured so as to be broken when disconnected after connected to the container body or the closing lid so that it cannot be reused.

Therefore, the spent developer cartridge container is disassembled into the container body, the closing lid, and the cylindrical connecting member on which the resilient thin wall container is mounted. The cylindrical connecting member and the resilient thin wall container, which are broken when disassembled and hence are disabled, are not reused. The reusable container body and closing lid are washed, and they are assembled into the developer cartridge container by combining with a new cylindrical connecting member and a new resilient thin wall container.

Since the cylindrical connecting member and the resilient thin wall container are formed of the same material, they can easily be recycled as material for manufacturing different parts without being disconnected.

A method of recycling a developer cartridge container according to the tenth aspect of the invention of the present application is a method of recycling the developer cartridge including: a container body including an developer storage chamber having an opening at one end; a closing lid including a cylindrical wall, an end wall connected to the cylindrical wall and having a coupler mounting portion, a developer discharge port provided on the end wall or the cylindrical wall, and a detachable portion detachable to the container body; a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end, a connecting portion of one of the container-body-side connecting portion and the closing-lid-side connecting portion being configured so as to be broken when disconnected after connected to the container body or the closing lid so that it cannot be reused; a resilient thin wall container having an opening to be attached to the outer peripheral surface of the cylindrical insertion portion of the cylindrical connecting member in a tightly adhered state being formed of the same material as the cylindrical connecting member, and accommodated in the container body; a coupler for transmitting a rotational force rotatably supported at the center of the end wall of the closing lid; a developer mixing member accommodated in the developer cartridge container and connected to the coupler; a developer discharging auger rotatably accommodated in the cylindrical developer discharge tube (13*e*); a discharge port opening-closing member including a fitting portion to be detachably fitted to the developer discharge port, an auger connecting portion to which the outer end of the developer discharging auger is connected, a shaft projecting outwardly of the developer discharge tube, and a connecting portion for transmitting a rotational force provided at the outer end of the shaft, the discharge port opening-closing member closing the developer discharge port in a state of being fitted to the developer discharge port, opening the developer discharge port in a state of being disconnected from the developer discharge port, and being rotatable integrally with the developer auger in the disconnected state wherein the spent developer cartridge is disassembled into the container body, the closing lid to which the coupler and the developer mixing member are mounted, the discharge port opening-closing member to which the developer discharge auger is connected, and the cylindrical connecting member to which the resilient thin wall container is mounted, and in that the cylindrical connecting member and the resilient thin wall container, which are broken when disassembled and hence are disabled, are not reused, the container body, the closing lid to which the coupler and the developer mixing member are mounted, and the discharge port opening-closing member to which the auger is connected are washed, and the developer cartridge is formed by assembling the washed parts with a new cylindrical connecting member and a new resilient thin wall container.

In the method of recycling the developer cartridge container according to the tenth aspect of the invention, the spent developer cartridge is disassembled into the container body, the closing lid to which the coupler (16) and the developer mixing member are mounted, the discharge port opening-closing member to which the developer discharge auger is connected, and the cylindrical connecting member to which the resilient thin wall container is mounted.

The cylindrical connecting member and the resilient thin wall container, which are broken when disassembled and thus are disabled, are not reused. The container body, the closing lid to which the coupler and the developer mixing member are mounted, and the discharge port opening-closing member to which the auger is connected are washed, and the developer cartridge is formed by assembling the washed parts with a new cylindrical connecting member and a new resilient thin wall container.

Since the cylindrical connecting member and the resilient thin wall container are formed of the same material, they can easily be recycled as a material for manufacturing different parts without being disconnected.

The developer container used in the image forming unit and the developer cartridge of the present invention described above has the following effects (E01) and (E02).

(E01) The spent developer cartridge container used in the image forming unit can be divided into parts having easy-to-wash configurations when washing for recycling (reuse).

(E02) The spent parts can easily be washed when recycling the developer cartridge to be used in the image forming unit.

BRIEF DESCRIPTION OF THE DRAWINGS

These and other objects and advantages of this invention will become more fully apparent from the following detailed description taken with the accompanying drawings in which:

FIGS. 4A and 4B are explanatory drawings showing a state in which the developer cartridge is mounted to the cartridge mounting member and a rotatable discharge member for discharging developer in the developer cartridge into the developer mixing container is not yet connected to a member for transmitting a rotational force to the discharge member in which FIG. 4A is a cross-sectional side view, and FIG. 4B is a cross-section taken along the line IVB—IVB in FIG. 4A;

FIGS. 5A and 5B are explanatory drawings showing a state in which the developer cartridge is mounted to the cartridge mounting member, and the rotatably discharge member for discharging developer in the developer cartridge into the developer mixing container and the member for transmitting a rotational force to the discharge member are connected, in which FIG. 5A is a cross-sectional side view, and FIG. 5B is a cross-section taken along the line VB—VB in FIG. 5A;

FIG. 6A is a side view, FIG. 6B is a plan view when viewed in the direction indicated by an arrow VIB in FIG. 6A, and FIG. 6C is a front view when viewed in the direction indicated by an arrow VIC—VIC in FIG. 6A;

FIGS. 12A to 12E are explanatory drawings of the container body of the developer cartridge according to the first embodiment, in which FIG. 12A is a side view, FIG. 12B is a drawing when viewed in the direction indicated by an arrow XIIB—XIIB in FIG. 12A, FIG. 12C is a drawing when viewed in the direction indicated by an arrow XIIC—XIIC in FIG. 12A, FIG. 12D is an enlarged view partly in cross-section of the portion shown by an arrow XIID in FIG. 12A, and FIG. 12E is an enlarged view of the portion of FIG. 12B when viewed in the direction indicated by an arrow XIIE;

FIGS. 13A and 13B are explanatory drawings of the cylindrical connecting member 19, in which FIG. 13A is a cross-sectional side view, and FIG. 13B is a drawing when viewed in the direction indicated by an arrow XIIIB in FIG. 13A;

FIGS. 14A and 14B are explanatory drawings of the closing lid, in which FIG. 14A is a cross-sectional side view of the closing lid, FIG. 14B is a drawing when viewed in the direction indicated by an arrow XIVB in FIG. 14A;

FIGS. 15A to 15F are explanatory drawings of a coupler to be detachably mounted to the closing lid, in which FIG. 15A is a cross-sectional side view, FIG. 15B is a drawing when viewed in the direction indicated by an arrow XVB in FIG. 15A, FIG. 15C is a drawing when viewed from the direction indicated by an arrow XVC in FIG. 15B, FIG. 15D is a drawing when viewed in the direction indicated by an arrow XVD in FIG. 15C, FIG. 15E is an enlarged drawing of the portion indicated by an arrow XVE in FIG. 15C, and FIG. 15F is a perspective view of a coupler;

FIGS. 16A to 16D are explanatory drawings of the connecting member for transmitting a rotational force to the. developer discharging auger, in which FIG. 16B is a drawing when viewed in the direction indicated by an arrow XVIB in FIG. 16A, FIG. 16C is a drawing when viewed in the direction indicated by an arrow XVIC in FIG. 1A, and FIG. 16D is an enlarged view of the portion indicated by an arrow XVXD in FIG. 16A;

FIGS. 17A and 17B are explanatory drawings of the developer cartridge according to a second embodiment of the present invention, in which FIG. 17A is a drawing showing a state immediately before completion of mounting of the developer cartridge to the cartridge mounting member, and FIG. 17B is a drawing when viewed in the direction indicated by an arrow XVIXB—XVIIB in FIG. 17A.

DETAILED DESCRIPTION OF THE PREFERRED EMBODIMENTS

Figure 1:
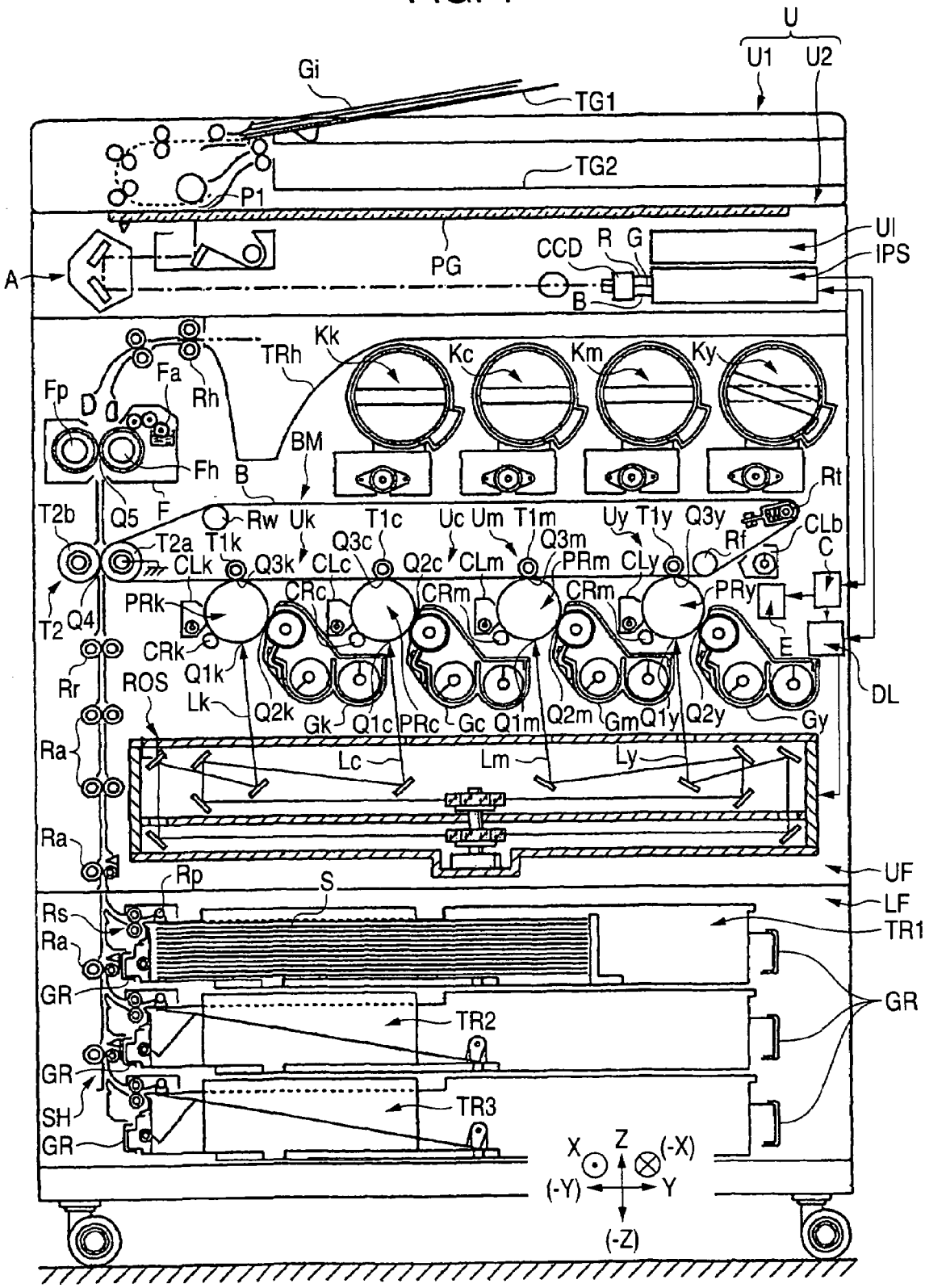
FIG. 1 is a front cross sectional view of a first embodiment of an image forming unit according to the invention.

Referring now to the drawings, the detailed examples of embodiments of the present invention will be described. However, the present invention is not limited to the following embodiments.

For the sake of easy understanding of the description below, in the drawings, the fore-and-aft direction is represented by X-axis direction, the lateral direction is represented by Y-axis direction, and the vertical direction is represented by Z-axis direction. Directions or sides indicated by arrows X, −X, Y, −Y, Z, and −Z represent frontward, rearward, rightward, leftward, upward, and downward, or front side, rear side, right side, left side, upper side, and lower side, respectively.

In the drawings, a circle with a dot inside represents an arrow directing from the back side to the front side of the sheet, and a circle with a cross inside represents an arrow directing from the front side to the back side of the sheet.

First Embodiment

FIG. 1 is a front cross sectional view of a first embodiment of an image forming unit according to the present invention.

In FIG. 1, an image forming unit U includes an automatic document feeding unit U1 and an image forming unit body (copying machine) U2 for supporting the image forming unit U and having a platen glass PG at the upper end thereof.

The automatic document feeding unit U1 includes a document supplying tray TG1 on which a plurality of documents Gi to be copied are placed in stack, and a document discharge tray TG2 to which the document Gi fed from the document feeding tray TG1 through the copying position (document reading position) on the platen glass PG.

The image forming unit body U2 includes an U1 (user interface) to be operated by an user for inputting the operation instruction signal such as "copystart", and an exposure optical system A.

A reflected light beam from the document fed by the automatic document feeding unit U2 over the platen glass PG or from the document manually placed on the platen glass PG (not shown) is converted into electric signals of R (red), G (green), and B (blue) by a CCD (charge coupled device) via the exposure optical system A.

An IPS (image processing system) converts electric signals of the RGB supplied from the CCD into an image data of Y (yellow), M (magenta), C (cyan), and K (black) and stores temporarily, and then outputs the image data to a laser drive circuit DL as image data for forming latent images at a predetermined timing.

When the image on the document is monochrome, the image data of only K (black) is supplied to the laser drive circuit DL.

The laser drive circuit DL includes laser drive circuits (not shown) for each color of Y, M, C, and K, and outputs the laser drive signal (not shown) according to the supplied image data to laser diodes for writing the latent image of each color in an exposure unit ROS at a predetermined timing.

Operation of the IPS, the laser drive circuit DL and a power source circuit E (described later) is controlled by a controller C.

In FIG. 1, disposed upwardly of the ROS are toner image forming units Uy, Um, Uc, and Uk for forming toner images of each color of Y (yellow), M (magenta), C (cyan), and K (black).

Laser beams Ly, Lm, Lc, and Lk of Y, M, C, and K emitted from the respective laser diodes, not shown, of the exposure unit ROS enter into rotating photoreceptors PRy, PRM, PRc, and PRk, respectively. The PRy, PRm, PRc, and PRk each has a photosensitive layer provided on a conductive base substance.

In FIG. 1, the toner image forming unit Uy of the Y includes the rotating photoreceptor PRy, an electrostatic roll (electrostatic member) CRy, a developing unit Gy, and a cleaner CLy being in contact with the photoreceptor PRy in the counter direction and having a resilient cleaning blade.

The photoreceptor PRy and the electrostatic roll (electrostatic member) CRy constitute a CRU (cartridge unit), and the CRU is replaced when its lifetime is over, The toner image forming units Um, Uc, and Uk (See FIG. 1) are configured to have the same configuration as the toner image forming unit Uy of Y described above.

The toner image developed on the surfaces of the photoreceptors PRy to PRk are fed to primary transfer areas Q3*y*, Q3*m*, Q3*c*, and Q3*k* which come in contact with an intermediate transfer belt (transferred material) B. On primary transfer rolls (toner image transfer member on the photoreceptor) T1*y*, T1*m*, T2*c*, and T1*k* disposed on the back side of the intermediate transfer belt B in the primary transfer areas Q3*y*, Q3*m*, Q3*c* and Q3*k*, a primary transfer bias of the opposite polarity from the electrostatic polarity of the toner is applied from the power source circuit E controlled by the controller C at a predetermined timing.

The toner images on the respective photoreceptors PRy to PRk are primarily transferred to the intermediate transfer belt B by the primary transfer rolls T1*y*, T1*m*, T1*c*, and T1*k*. The residual toner on the surfaces of the photoreceptors PRy, PRm, PRC, and PRk after the primary transfer is cleaned by cleaners CLy, Clam, CLc, and CLk having the resilient cleaning blades which are in contact with the surfaces of the photoreceptors in the counter direction.

Belt module BM which is movable in the vertical direction and is capable of being pulled frontward is disposed upwardly of the photoreceptors PRy to PRk. The belt module BM includes the intermediate transfer belt B, a tension roll Rt, a walking roll Rw, belt supporting rolls (Rt, Rw, Rf, and T2*a*) including the idler roll (free roll) Rf and the backup roll T2*a* which also serves as a drive roll, and the primary transfer rolls T1*y*, T1*m*, T1*c*, and T1*k*. The intermediate transfer belt B is rotatably supported by the belt supporting rolls (Rt, Rw, Rf, and T2*a*). Therefore, an intermediate transfer belt drive unit, that is, an intermediate transfer material feeding unit (Rt, Rw, Rf, T2*a*) for feeding the intermediate transfer belt 13 is made up by the drive unit for rotating the back up roll T2*a* which also serves as the drive roll and the belt supporting rolls (Rt, Rw, Rf and T2*a*).

A secondary transfer roll T2*b* is disposed so as to oppose the surface of the intermediate transfer belt B which comes into contact with the backup roll T2*a*, and a secondary transfer unit T2 is made up of the respective rolls T2*a* and T2*b*. A secondary transfer area Q4 is formed in the area to which the secondary transfer roll T2*b* and the intermediate transfer belt B oppose.

The color toner images transferred in piles on the intermediate transfer belt B in sequence by the transfer units T1*y*, T1*m*, T1*c*, and T1*k* in the primary transfer areas Q3*y*, Q3*m*, Q3*c*, and Q3*k* are fed to the secondary transfer area Q4.

Provided downwardly of the ROS are pairs of left and right guide rails GR, GR for supporting the sheet feeding trays TR1 to TR3 so as to be capable of projecting and retracting in the fore-and-aft direction (X-axis direction) in three stages. Recording sheets (transferred material) S on the sheet feeding trays TR1 to TR3 are picked up by the pickup roll Rp, and separated into piece by a separating roll Rs, and fed to a register roll Rr by a plurality of feeding rolls Ra. The plurality of sheet feeding rolls Ra are provided along a sheet feeding path SH defined by the sheet guide, and the register roll Rr is disposed upstream of the secondary transfer area Q4 in the direction of travel. A sheet feeding unit (SH+Ra+Rr) is made up of the sheet feeding path SH, the sheet feeding roll Ra, and the register roll Rr.

The register roll Rr feeds the recording sheet S to the secondary transfer area Q4 at the timing that the color toner image formed on the intermediate transfer belt a is transferred to the secondary transfer area Q4. When the recording sheet S passes through the second transfer area Q4, the backup roll T2*a* is earthed, and a secondary transfer voltage which has the opposite polarity from the statistic polarity of the toner is applied to the secondary transfer roll T2*b* from the power source circuit E controlled by the controller C at a predetermined timing. At this time, the color toner image on the intermediate transfer belt B is transferred onto the recording sheet S by the secondary transfer unit T2.

The primary transfer rolls T1*y* to T1*k*, the intermediate transfer belt B, and the secondary transfer unit T2 constitute the sheet transfer unit (T1*y*–T1*k*+B+T2) which transfer the toner images formed on the surfaces of the respective photoreceptors PRy-PRk onto the recording sheet S.

The intermediate belt B after the secondary transfer is cleaned by the cleaning blade of a belt cleaner CLb.

The recording sheet S on which the toner images are secondarily transferred is fed to a fixing area Q5, which is an area in which a heating roll Fh and a pressurizing roll Fp of a fixing unit F come into press contact with each other, is subjected to heat-fixation when passing through the fixing area Q5, and is discharged from a discharge roller Rh to a discharge tray TRh.

Separating agent for achieving good separability of the recording sheet S from the heating roll is applied on the surface of the heating roll Fh by a separating agent application unit Fa.

Developer cartridges Ky, Km, Kc, and Kk for storing the developer of the respective colors of Y (yellow), M (magenta), C (cyan), and K (black) are disposed upwardly of the belt module BM. The developers stored in the respective developer cartridges Ky, KA, Kc, and Kk are replenished to the respective developing units Gy, Gm, GC, and Gk through a developer replenishment path (described later in conjunction with FIG. 2) according to consumption of the developer in the developing units Gy, Gm, Gc, and Gk.

In FIG. 1, the image forming unit U includes an upper frame UF and a lower frame LF, and the upper frame UF supports the ROS and the members disposed upwardly of the ROS (the photoreceptors PRy, PRm, PRc, and PRk, the developing units Gy, Gm, Gc, and Gk, and the belt module SM).

The lower frame LF supports the guide rail GR for supporting the sheet discharge trays TR1 to TR3 and the sheet feeding members for feeding the sheets from the respective trays TR1 to TR3 (the pickup roll RP, the separating roll Rs, and the sheet feeding roll Ra).

Figure 2:
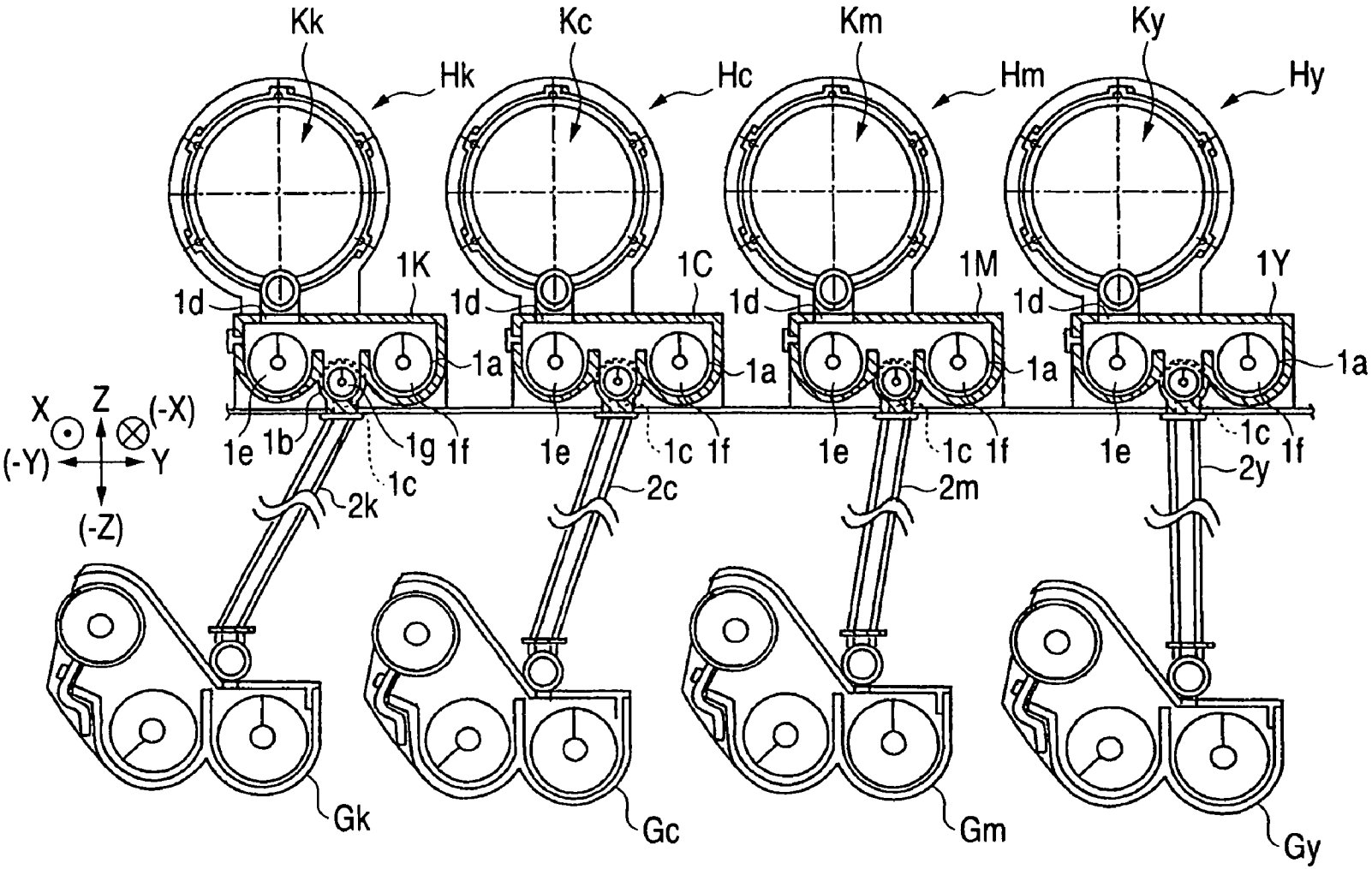
FIG. 2 is an explanatory drawing of the developer replenishing path for replenishing developer stored in the respective developer cartridges Ky, Km, Kc, and Kk in FIG. 1 to the respective developing unit Gy, Gm, Gc, and Gk.

FIG. 2 is an explanatory drawing of the developer replenishing path for replenishing developer stored in the respective developer cartridges Ky, Km, Kc, and Kk in FIG. 1 to the respective developing units Gy, Gm, Gc, and Gk.

In FIG. 2, the respective developer cartridges Ky, Km, Kc, and Kk are detachably mounted to respective cartridge mounting members Hy, Hm, Hc, and Hk provided in the image forming unitU. Disposed downwardly of the respective cartridge mounting members Hy, Hm, Hc, and Hk are developer mixing containers 1Y, 1M, 1C, and 1K, respectively. The developer stored in the respective developer cartridges Ky, Km, Kc and Kk mounted to the cartridge mounting member Hy, Hm, Hc, and Hk, respectively, are adapted to be replenished to the respective developer mixing containers 1Y, 1M, 1C, and 1K (details will be described later in conjunction with FIGS. 4A, 4B, 5A and 5B).

Since the respective developer cartridges Ky, Km, Kc, and Kk of the colors of Y (yellow), M (magenta), C (cyan), and K (black), the respective cartridge mounting members Hy, Hm, Hc, and Hk, and the respective developer mixing containers 1Y, 1M, 1C, and 1K have the same structure, the developer cartridge Ky, the cartridge mounting member Hy, and the developer mixing container 1Y of Y (yellow) are described hereinafter.

Figure 3:
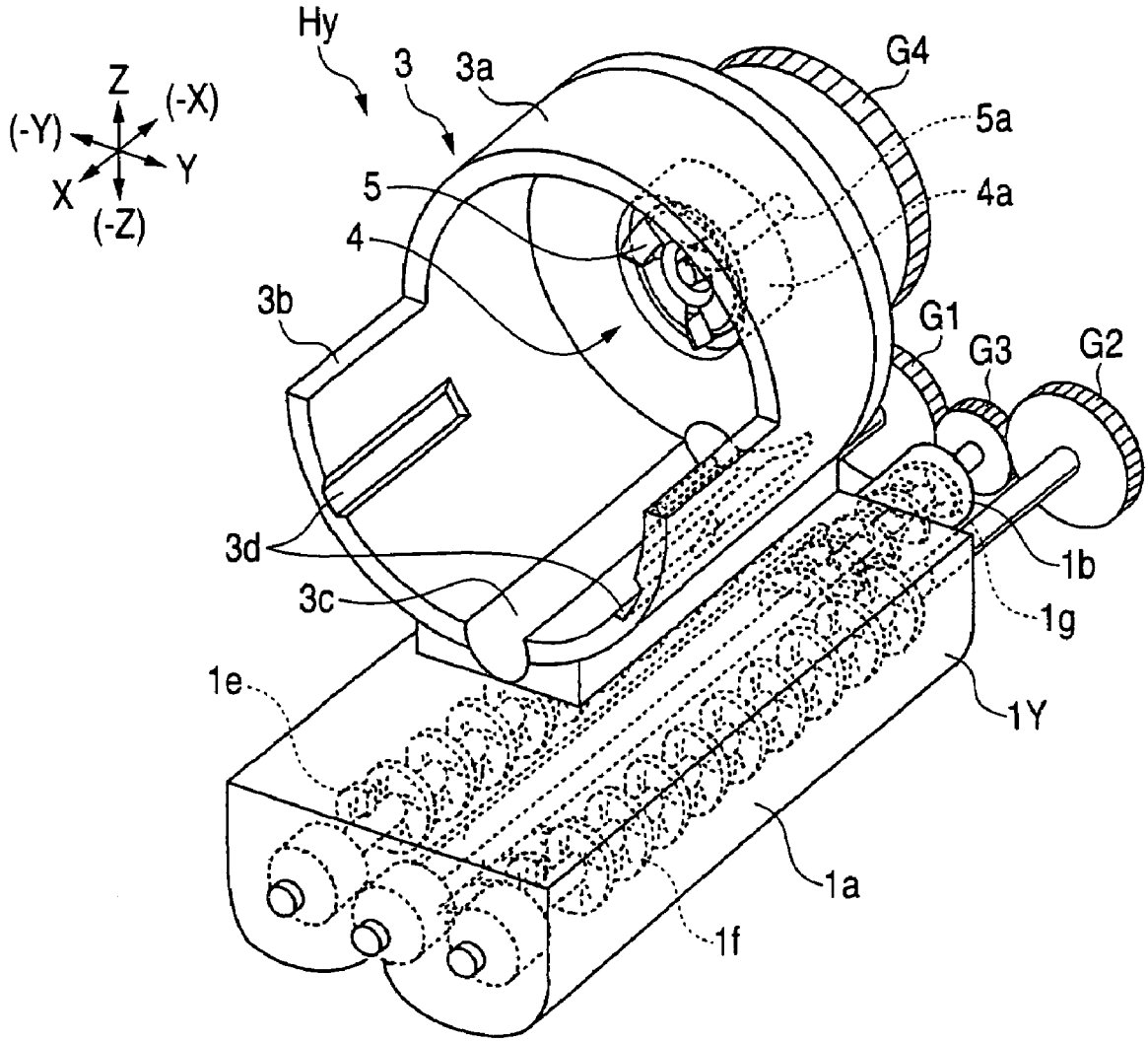
FIG. 3 is an explanatory perspective view showing the cartridge mounting member to which the developer cartridge is mounted and the developer mixing container.

FIG. 3 is an explanatory perspective view showing the cartridge mounting member to which the developer cartridge is mounted and the developer mixing container in FIG. 1.

In FIG. 2 and FIG. 3, the developer mixing container 1Y includes a developer storage container 1*a*, a discharge tube 1*b* projecting rearwardly of the developer storage container 1*a*, a discharge port 1*c* provided on the lower surface of the discharge tube 1*b*, and a developer intake port 1*d*. The developer intake port 1*d* is a part through which developer supplied from the developer cartridge Ky is flown in. The structure in which developer in the developer cartridge Ky is replenished into the developer intake port 1*d* of the developer mixing container 1Y will be described later in conjunction with FIGS. 4A, 4B, 5A and 5B.

In FIG. 3, a pair of parallel first mixing member 1*e* and a second mixing member 1*f* are rotatably accommodated in the developer storage container 1*a*, and shafts of the mixing members 1*e* and 1*f* project rearwardly of the developer storage container 1*a*, and are provided with gears G1 and G2 at the rear ends thereof. A discharge member 1*g* is rotatably accommodated in the discharge tube 1*b*, and a shaft of the discharge member 1*g* projects rearwardly of the discharge cylinder 1*b*, and is provided with a gear G3 at the rear end thereof. The gear G3 meshes with the gears G1 and G2.

The directions in which the respective mixing members 1*e* and 1*f* feed developer are opposite from each other. Therefore, developer in the developer mixing container 1*a* is mixed while circulating in the container 1*a*. Developer is discharged from the discharge port 1*c* (see FIG. 2) by rotation of the discharge member 1*g*.

In FIG. 2, developer replenished from the respective developer cartridges Ky–Kk through the developer intake port 1*d* into the developer mixing containers 1Y–1K is replenished to the developing units Gy–Gk through developer replenishing paths 2*y*–2*k*.

Figure 4A:
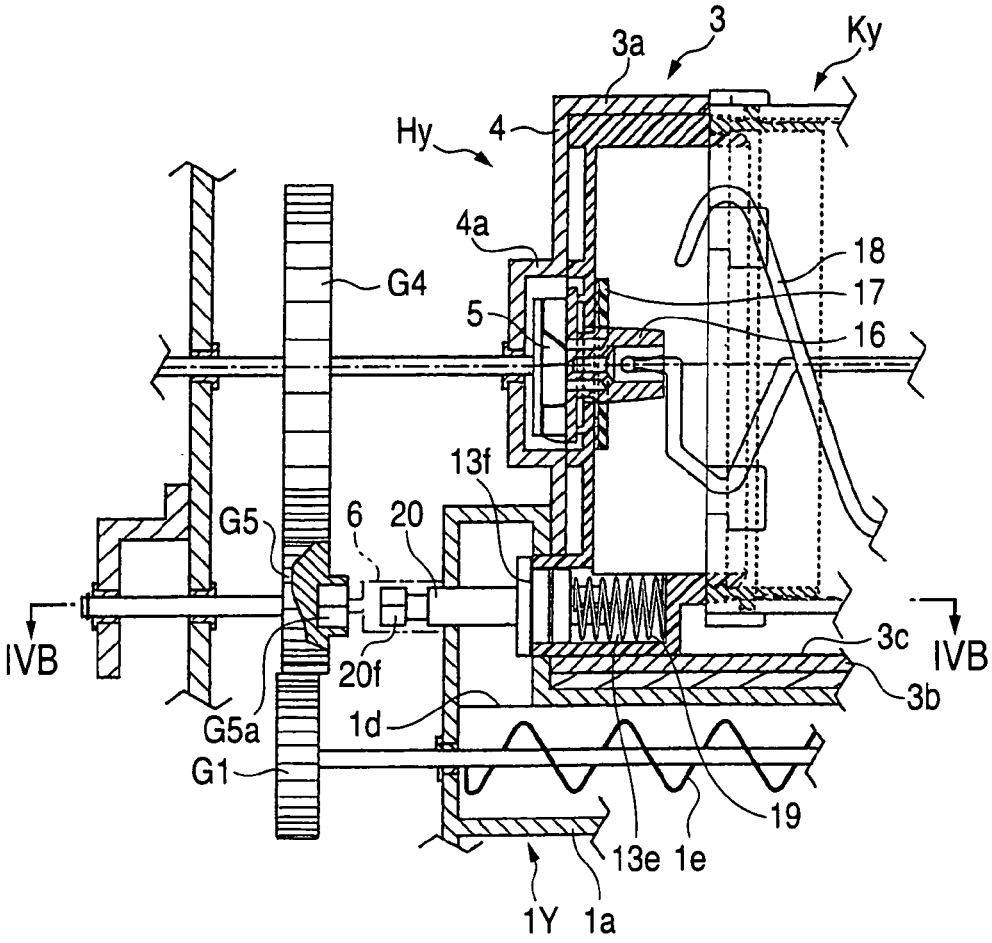
Figure 4B:
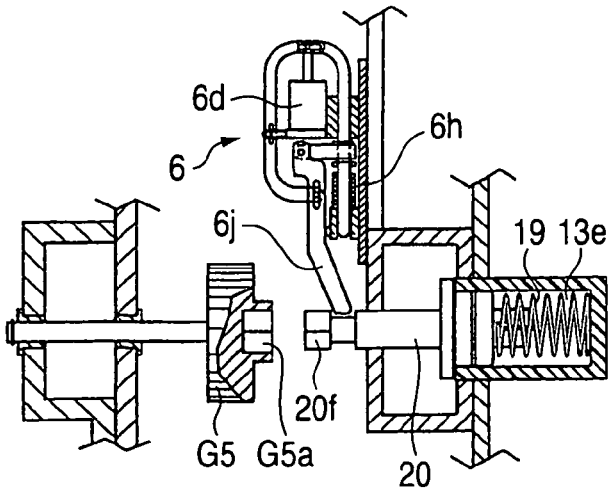

FIGS. 4A and 4B are explanatory drawings showing a state in which the developer cartridge is mounted to the cartridge mounting member and a rotatable discharge member for discharging developer in the developer cartridge into the developer mixing container is not yet connected to a member for transmitting a rotational force to the discharge member. FIG. 4A is a cross-sectional side view, and FIG. 4B is a cross-section taken along the line IVB—IVB in FIG. 4A.

Figure 5A:
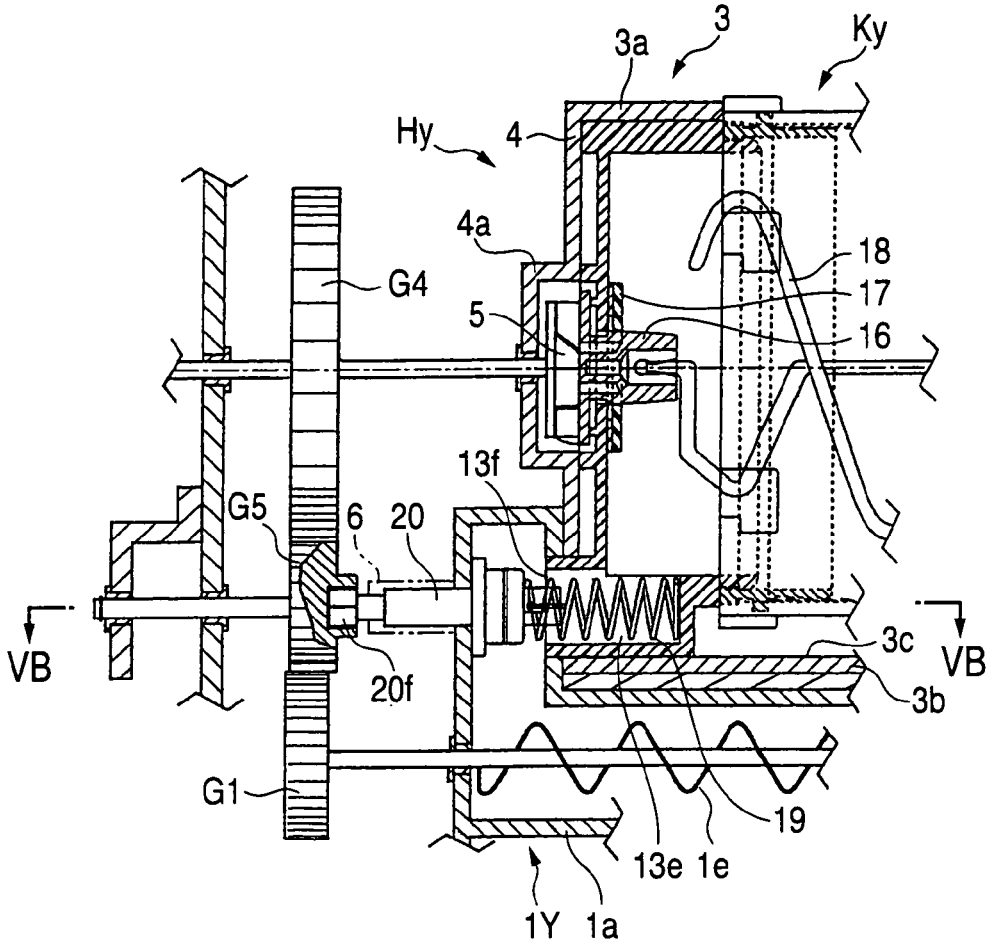
Figure 5B:
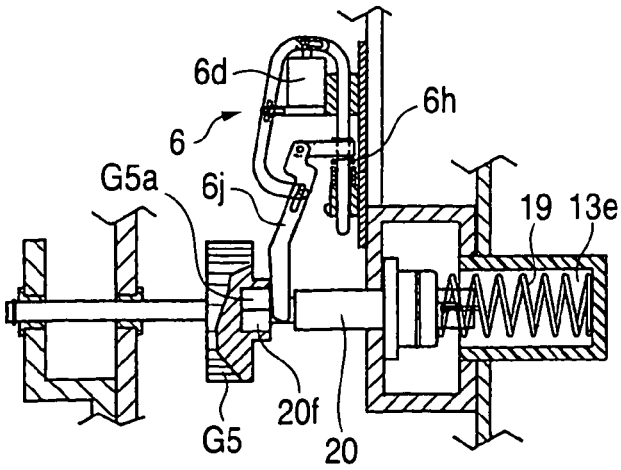

FIGS. 5A and 5B is an explanatory drawing showing a state in which the developer cartridge is mounted to the cartridge mounting member, and the rotatably discharge member for discharging developer in the developer cartridge into the developer mixing container and the member for transmitting the rotational force to the discharge member are connected. FIG. 5A is a cross-sectional side view, and FIG. 5B is a cross-section taken along the line VB—VB in FIG. 5A.

In FIG. 3 to FIGS. 5A and 5B, the cartridge mounting member Hy includes a rear part receiving cylindrical portion 3 to which the rear end of the developer cartridge Ky is mounted, and a rear end wall 4. The rear part receiving cylindrical portion 3 includes a circular portion 3*a* on the back side and the semi-circular portion 3*b* on the front side.

The semi-circular portion 3*b* is formed so as to project forwardly from the lower portion of the circular portion 3*a*. An arcuate groove 3*c* is formed in the axial direction at the lower end of the semi-circular portion 3*b*. Guide grooves 3*d* and 3*d* are formed in the axial direction at the angle of 60 degrees away from the arcuate groove 3*c* in the circumferential direction.

An evaginated portion 4*a* (see FIGS. 4A and 4B) evaginating rearward is formed at the center of the rear end wall 4. A coupler (rotational force transmitting claw) 5 is rotatably accommodated in the evaginated portion 4*a* and a shaft 5*a* of the coupler 5 extends rearward. A gear G4 is mounted to the rear end of the shaft 5*a*.

In FIGS. 4A, 4B, 5A and 5B, the gear G4 and the gear G1 mesh with the gear G5, and the gear G5 is formed with a shaft fitting hole G5*a* of hexagonal shape in cross-section.

Figure 6C:
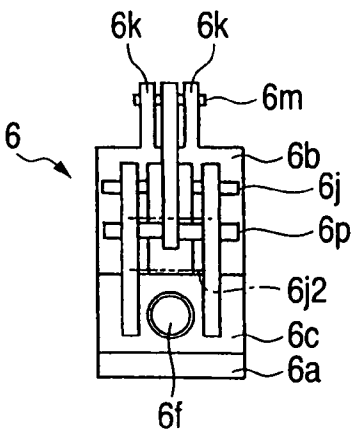
FIGS. 6A to 6C are explanatory drawings showing a connecting and disconnecting member for changing the relation of the rotatable developer discharge member of the developer cartridge Ky with the gear G5 between the disconnected state in FIGS. 4A and 4B, and the connected state in FIGS. 5A and 5B.
Figure 6A:
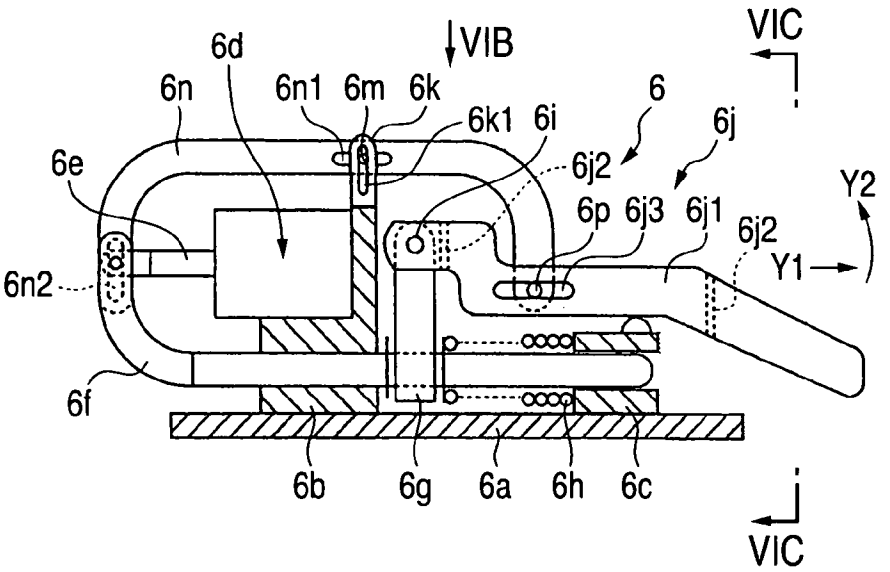
Figure 6B:
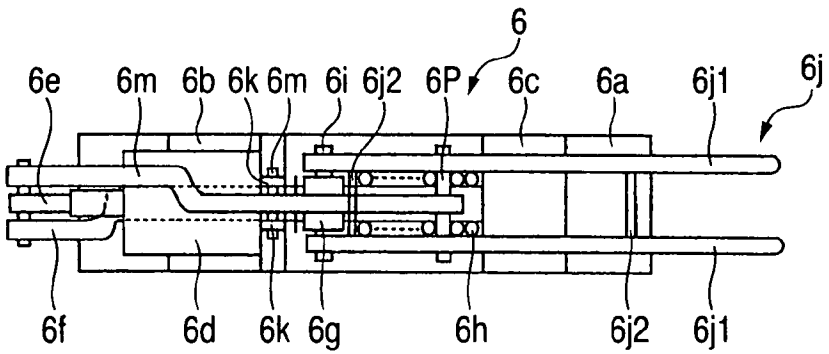

FIGS. 6A to 6C are explanatory drawings showing a connecting and disconnecting member for changing the relation of the rotatable developer discharge member of the developer cartridge Ky with the gear G5 between the disconnected state in FIGS. 4A and 4B and the connected state in FIGS. 5A and 5B. FIG. 6A is a side view, FIG. 6B is a plan view when viewed in the direction indicated by an arrow VIB in FIG. 6A, and FIG. 6C is a front view when viewed in the direction indicated by an arrow VIC—VIC in FIG. 6A.

In FIGS. 6A to 6C, a connecting and disconnecting member 6 includes a substrate 6*a*, a pair of guide blocks 6*b* and 6*c* secured to the substrate 6*a*, and a solenoid 6*d* secured to the guide block 6*b*. The rear end of the slide bar 6*f* slidably (capable of advancing and retracting) guided by the guide blocks 6*b*, 6*c* is rotatably connected to the distal end of a telescopic shaft 6*e* of the solenoid.

A connecting member 6*g* is secured to the intermediate portion of the slide bar 6*f*, and the slide bar 6*f* is constantly urged in the retracting direction by a compression spring 6*h*. An operating lever 6*j* is connected to the connecting member 6*g* so as to be rotatable about a hinge shaft 6*i*. The operating lever 6*j* includes a pair of parallel levers 6*j*1 and 6*j*1 disposed at a distance as will be clear from FIG. 6B, and a lever connecting portion 6*j*2 for connecting them. Elongated holes 6*j*3 and 6*j*3 are provided at the intermediate portions of pair of levers 6*j*1 6 and 6*j*1.

The block 6*b* is provided with a pair of parallel projections 6*k* and 6*k*. The projections 6*k* and 6*k* are formed with elongated holes 6*k*1 and 6*k*1 respectively, and pins 6*m* are supported by the elongated holes 6*k*1 and 6*k*1 so as to be slidable longitudinally of the elongated holes. Elongated hole 6*n*1 formed at the intermediate portion of the lever connecting member 6*n* slidably engages the pin 6*m*. An elongated hole 6*n*2 extending in the direction substantially perpendicular to the expanding direction of the telescopic shaft 6*e* of the solenoid is formed at the rear end of the lever connecting member 6*n* (the end of the operating lever 6*j* in the direction of retraction), and the elongated hole 6*n*2 is slidably connected to the pin at the extremity of the telescopic shaft 6*e*. A pin 6*p* is connected to the front end of the lever connecting member 6*n* (the forward end of the operating lever 6*j*), and the pin 6*p* slidably engages the elongated holes 6*j*3 and 6*j*3 of the pair of levers 6*j*1 and 6*j*1.

The connecting and disconnecting member 6 configured as described above is maintained in a state in which the slide bar 6*f* and the connecting member 6*g* capable of sliding in the fore-and-aft direction (the advancing and retracting direction) are moved backward (the state in which the telescopic shaft 6*e* is extended) by the compression spring 6*h* as shown in FIGS. 6A to 6C, when the solenoid 6*d* s OFF.

When the solenoid 6*d* is turned ON in this state, the telescopic shaft 6*e* is contracted and the slide bar 6*f*, the connecting member 6*g*, the operating lever 6*j*, and the lever connecting member 6*n* move forward (the direction indicated by an arrow Y1 in FIGS. 6A to 6C). At this time, the operating lever 6*j* moves in the direction indicated by the arrow Y1 in FIG. 6A and, simultaneously, rotates counterclockwise in FIGS. 6A to 6C (the direction indicated by an arrow Y2 in FIG. 6A) about the hinge shaft 6*i*.

At this time, the operating lever 6*j* moves from the state shown in FIG. 4B to the state shown in FIG. 5B.

Operation of the connecting and disconnecting member 6 shown in FIGS. 6A to 6C will be described in detail after description of the developer discharge member (described later in conjunction with FIGS. 16A to 16D) of the developer cartridge Ky.

(Description of the Developer Cartridge According to the First Embodiment)

Since the developer cartridges Ky–Kk have almost the same configuration, the developer cartridge Ky of Y (yellow) will be described.

Figure 7:
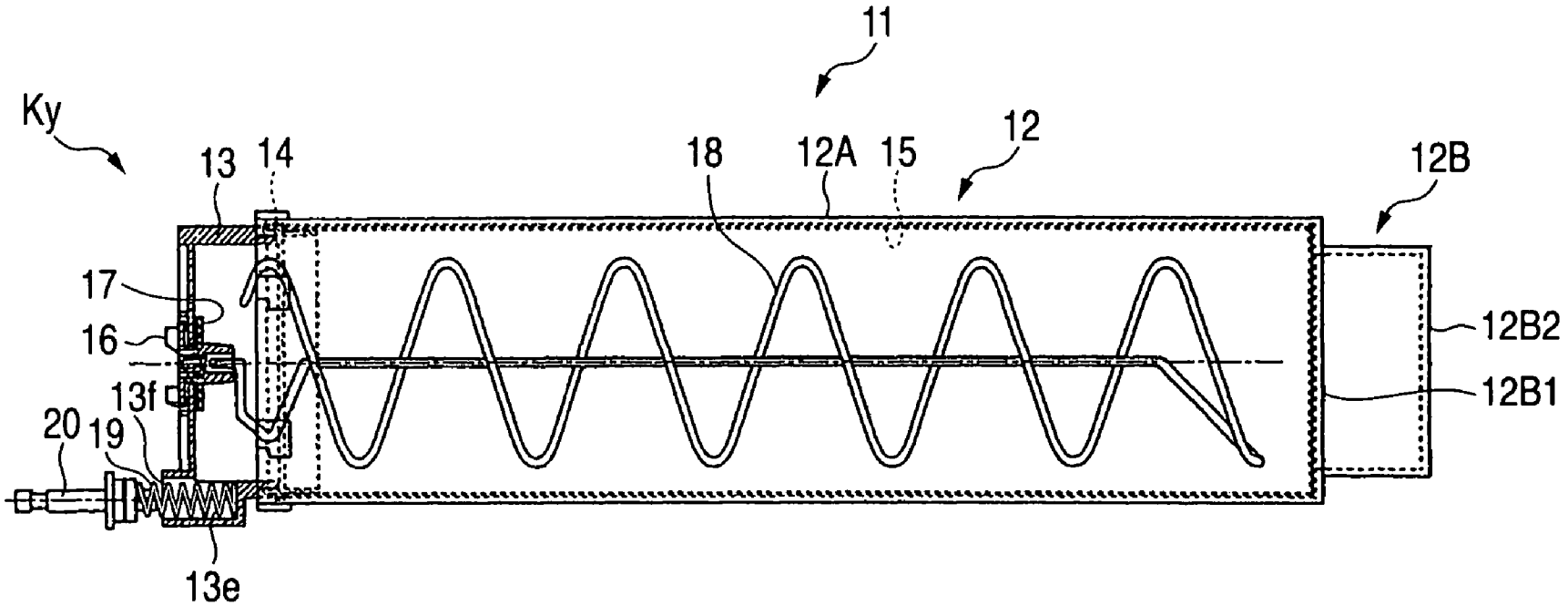
FIG. 7 is an explanatory drawing showing the entire developer cartridge of the image forming unit according to the first embodiment of the present invention.

FIG. 7 is an explanatory drawing showing the entire developer cartridge of the image forming unit according to the first embodiment of the present invention.

Figure 8:
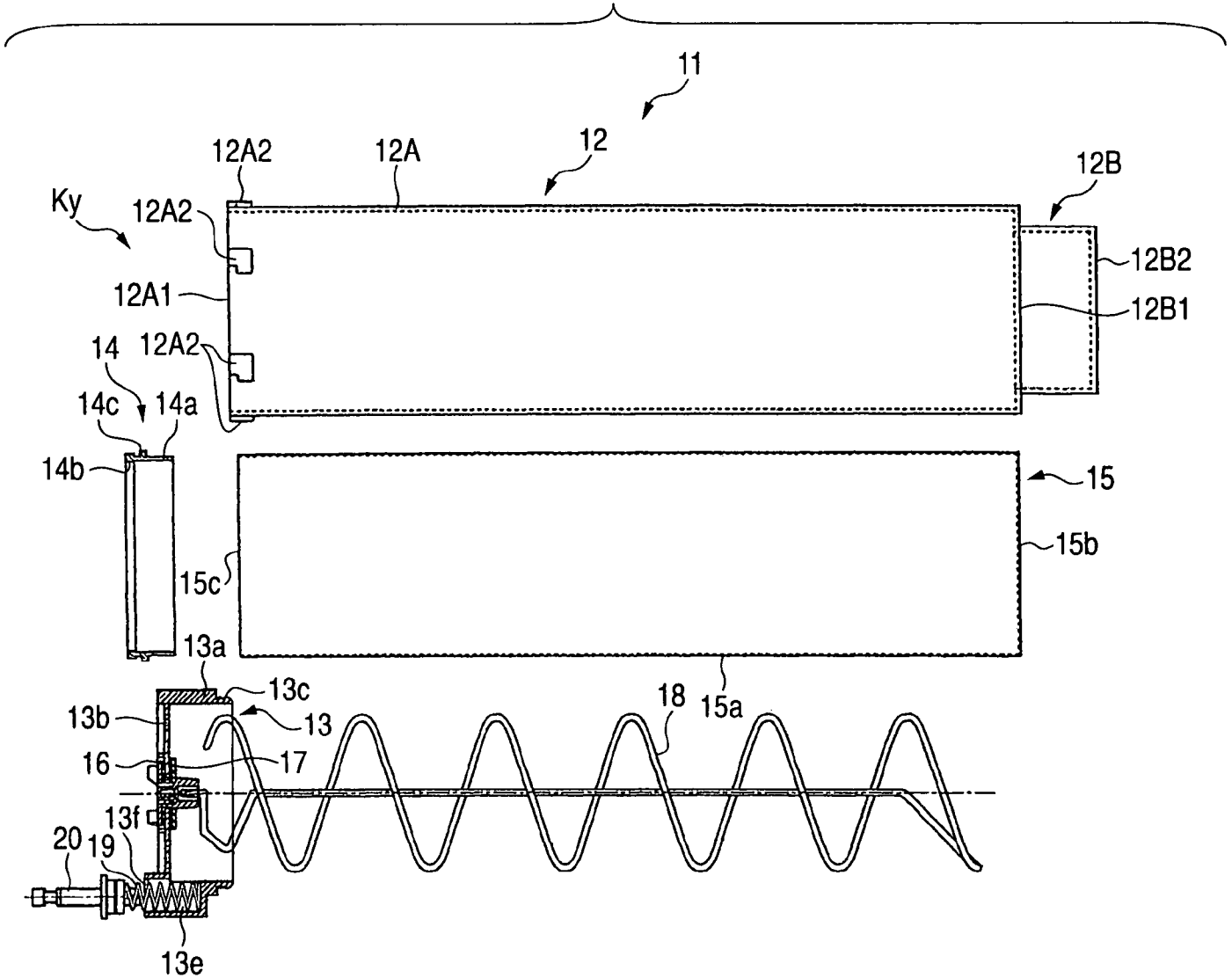
FIG. 8 is an exploded explanatory drawing of the developer cartridge shown in FIG. 7.

FIG. 8 is an exploded explanatory drawing of the developer cartridge shown in FIG. 7.

In FIG. 8, the developer cartridge Ky includes a rigid developer cartridge container 11. The rigid developer cartridge container 11 includes a cylindrical container body 12, and a closing lid 13 to be attached to and detached from the container body 12 directly or indirectly via another member. In the first embodiment, the container body 12 and the closing lid 13 are connected indirectly via a cylindrical connecting member 14.

The developer cartridge Ky includes a bottomed cylindrical resilient thin wall container 15 to be accommodated in the container body 12.

The cylindrical connecting member 14 and the resilient thin wall container 15 are formed of the same material (for example polypropylene). In this case, when collecting and recycling the spent developer cartridges Ky, they can easily be recycled as material for manufacturing different parts without disconnecting the cylindrical connecting member 14 and the resilient thin wall container 15.

The closing lid 13 is formed with a coupler through hole (coupler mounting portion) 13*d* and a developer discharging tube 13*e* described in conjunction with FIGS. 6A to 6C later. A coupler 16 for transmitting a rotational force is mounted to the closing lid 13 through the coupler through hole 13*d*, and a disk-shaped seat member 17 (described later) for sealing between the coupler 16 and the coupler through hole 13*d* is adhered to the inner surface of the closing lid 13. A mixing member 18 connected to the inner end of the coupler 16 is accommodated in the resilient thin wall container 15, and rotates integrally with the coupler 16.

A developer discharging auger (developer discharging member) 19 formed of a coil spring is rotatably accommodated in the developer discharge tube 13*e* formed integrally with the closing lid 13, and a discharge port opening-closing member 20 for transmitting a rotational force is connected to the outer end of the developer discharging auger 19. The developer discharging auger 19 is adapted to rotate when the discharge port opening-closing member 20 is rotated so that developer in the developer discharge tube 13*e* may be discharged.

Figure 9:
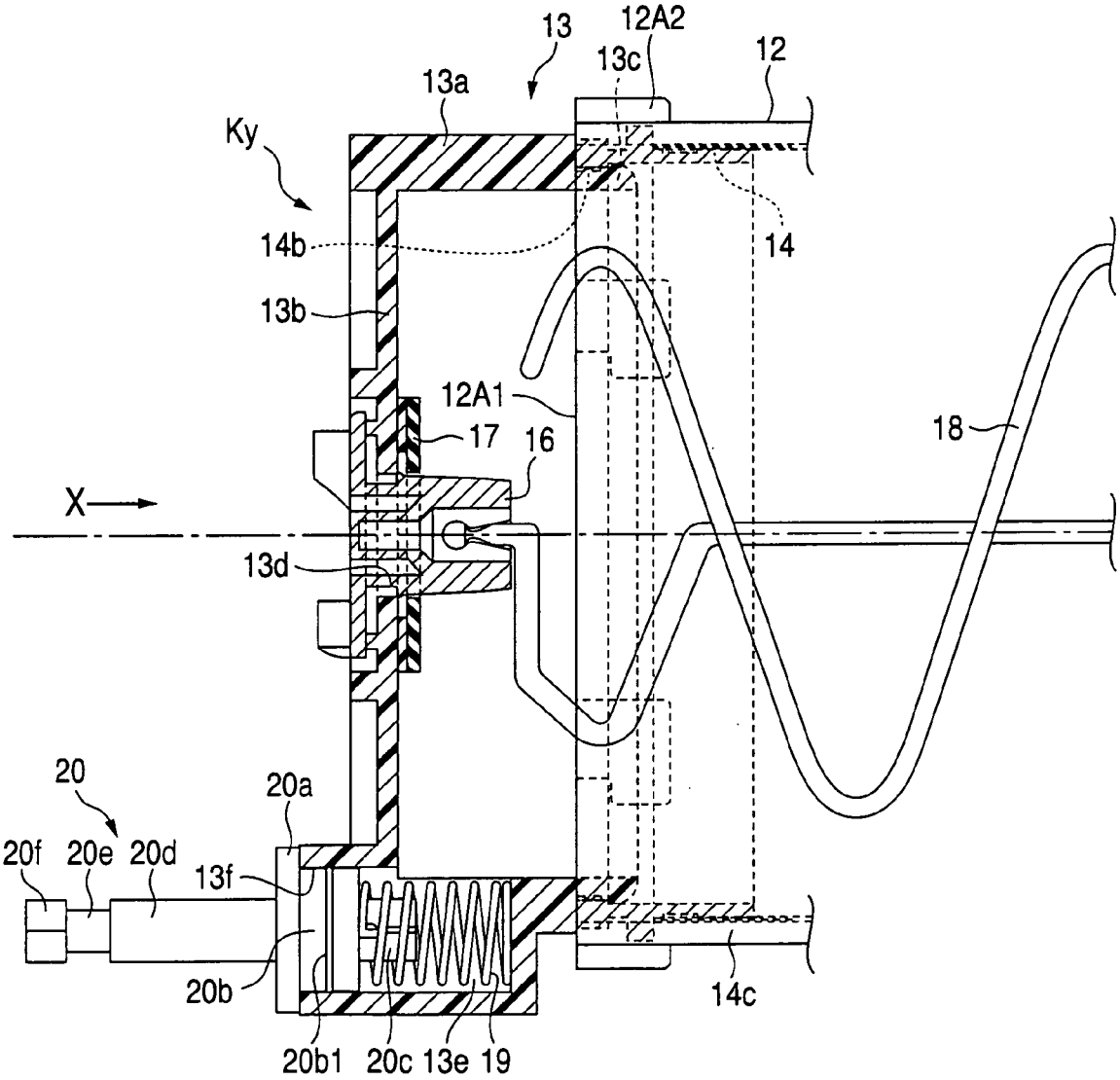
FIG. 9 is an enlarged cross-sectional view of the principal portion of FIG. 7.

FIG. 9 is an enlarged cross-sectional view of the principal portion of FIG. 7.

Figure 10:
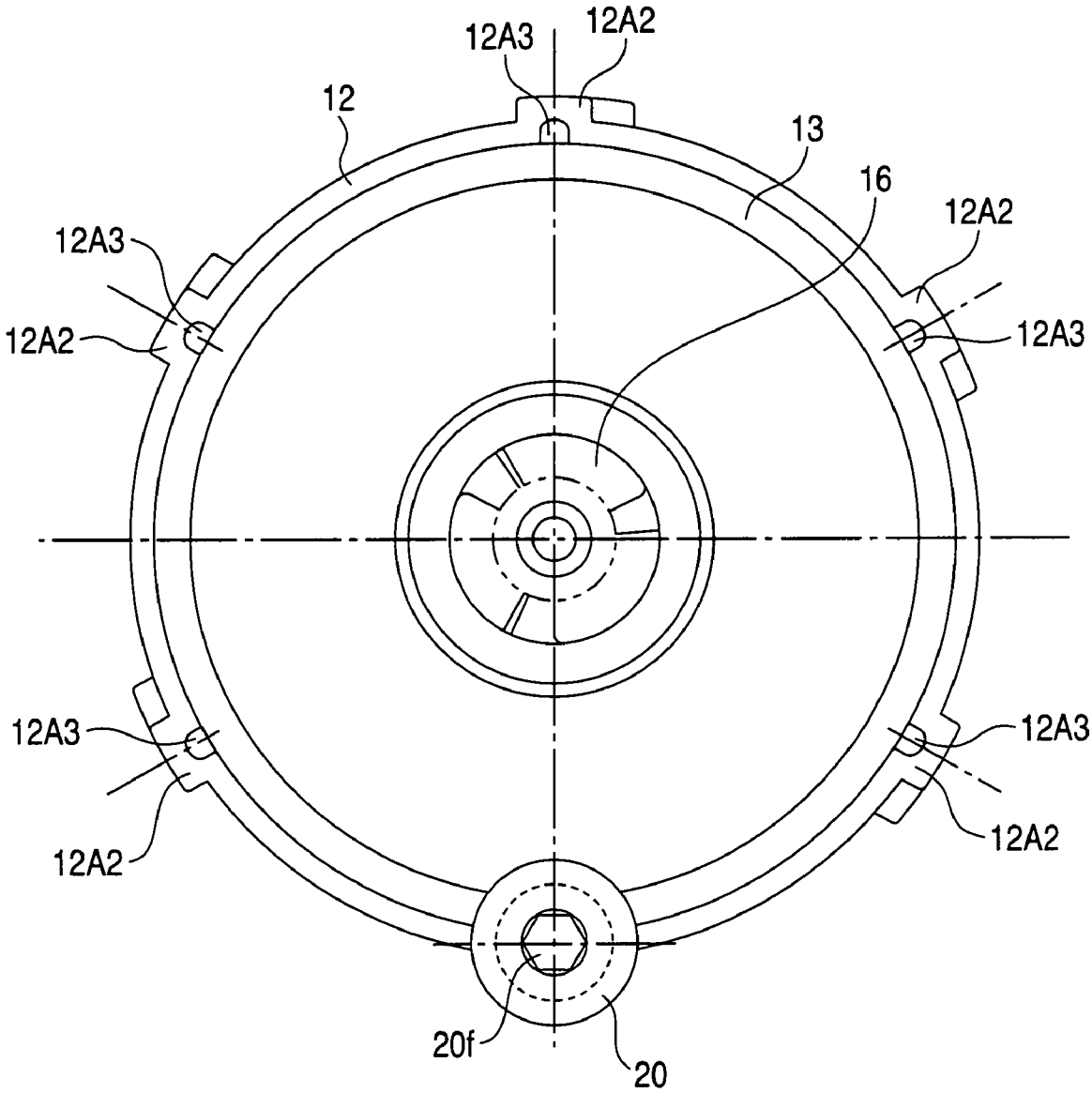
FIG. 10 is a drawing when viewed in the direction indicated by an arrow X in FIG. 9.

FIG. 10 is a drawing when viewed in the direction indicated by an arrow X in FIG. 9.

Figure 11:
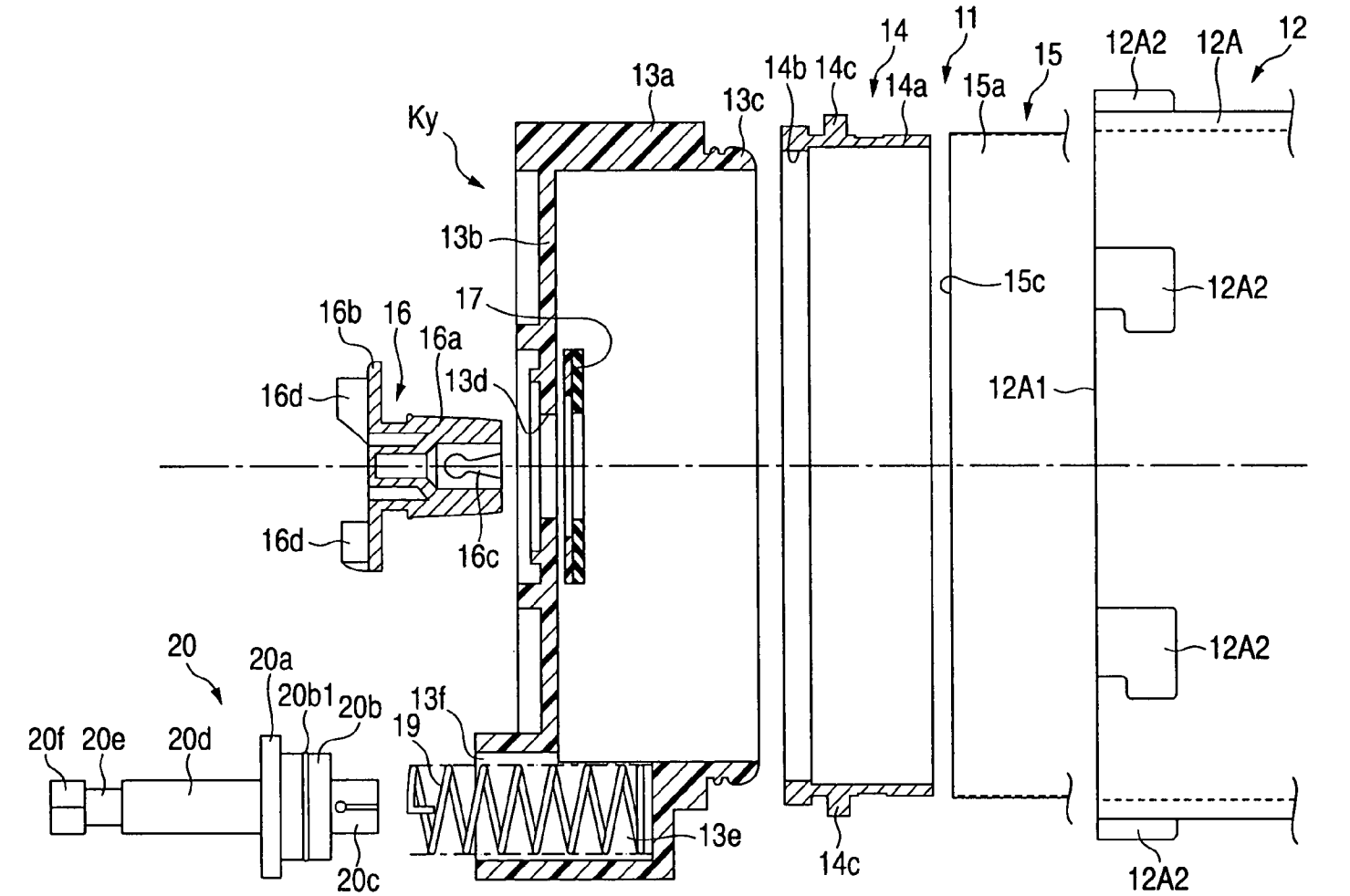
FIG. 11 is an exploded drawing of FIG. 9.

FIG. 11 is an exploded drawing of FIG. 9.

Figure 12A:
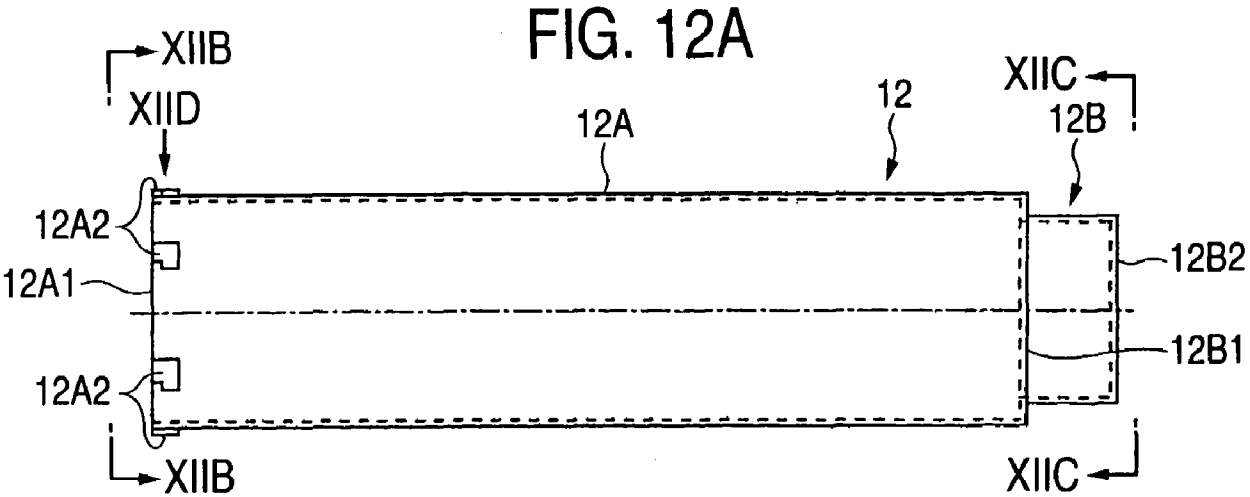
Figure 12B:
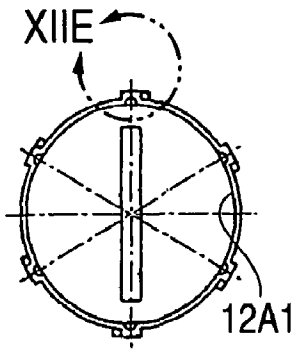
Figure 12E:
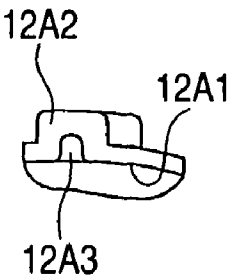
Figure 12D:
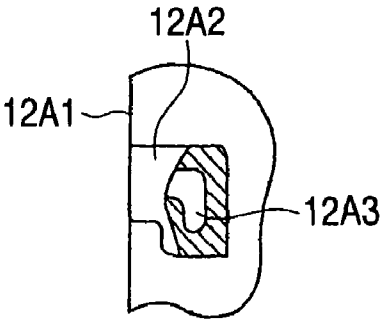
Figure 12C:
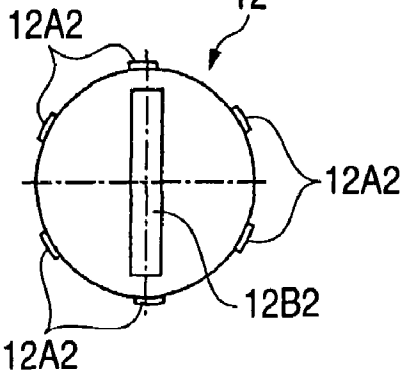

FIGS. 12A to 12E are explanatory drawings of the container body of the developer cartridge according to the first embodiment, in which FIG. 12A is a side view, FIG. 12B is a drawing when viewed in the direction indicated by an arrow XIIB—XIIB in FIG. 12A, FIG. 12C is a drawing when viewed in the direction indicated by an arrow XIIC—XIIC in FIG. 12A, FIG. 12D is an enlarged view partly in cross-section of the portion shown by an arrow XIID in FIG. 12A, and FIG. 12E is an enlarged view of the portion of FIG. 12B when viewed in the direction indicated by an arrow XIIE.

In FIGS. 12A to 12E, the container body 12 is a cylindrical member, and includes a cylindrical body 12A and a bottom wall member 12B for closing one end of the cylindrical body 12A. In the first embodiment, the cylindrical body 12A and the bottom wall member 12B are integrally formed. The cylindrical body 12A and the bottom wall member 12B may be separate members. The cylindrical body 12A is formed with an opening 12A1 at the location opposite from the bottom wall member 12B. Six engaging groove forming members 12A2 in total are provided on the outer peripheral surface of the opening 12A1 at intervals of 60 degrees in the circumferential direction. The engaging groove forming member 12A2 is formed with an engaging groove 12A3. In FIG. 12D, the outer end of the engaging groove 12A3 extends axially of the container body 12, and the inner end thereof extends in the circumferential direction.

In FIG. 12A, the bottom wall member 12B provided at the right end of the cylindrical body 12A includes a bottom wall 12B1 for closing the right end of the cylindrical body 12A and a handle 12B2 projecting leftward from the outer surface thereof.

In FIG. 8 and FIG. 11, the resilient thin wall container 15 is a cylindrical member, and includes a cylindrical wall 15*a* and a bottom wall 15*b* formed integrally at the right end thereof. An opening 15*c* is formed at the left end of the resilient thin wall container 15. The resilient thin wall container 15 is accommodated in the container body 12.

Figure 13A:
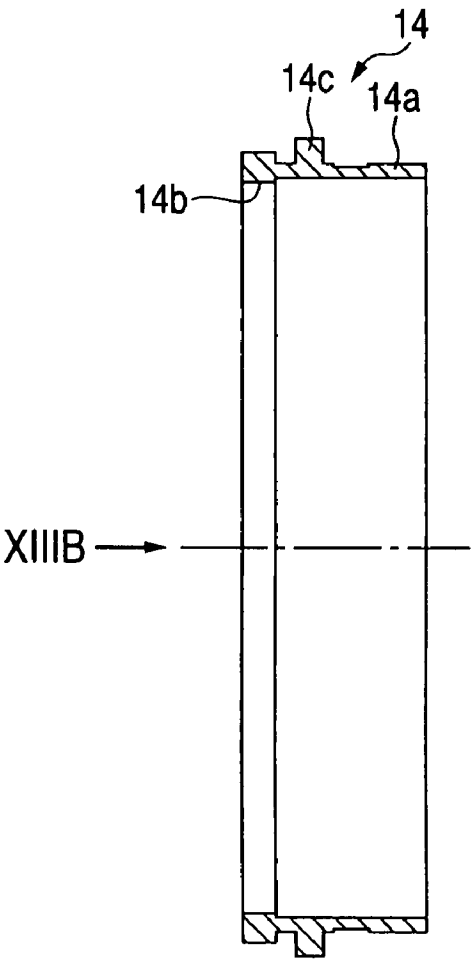
Figure 13B:
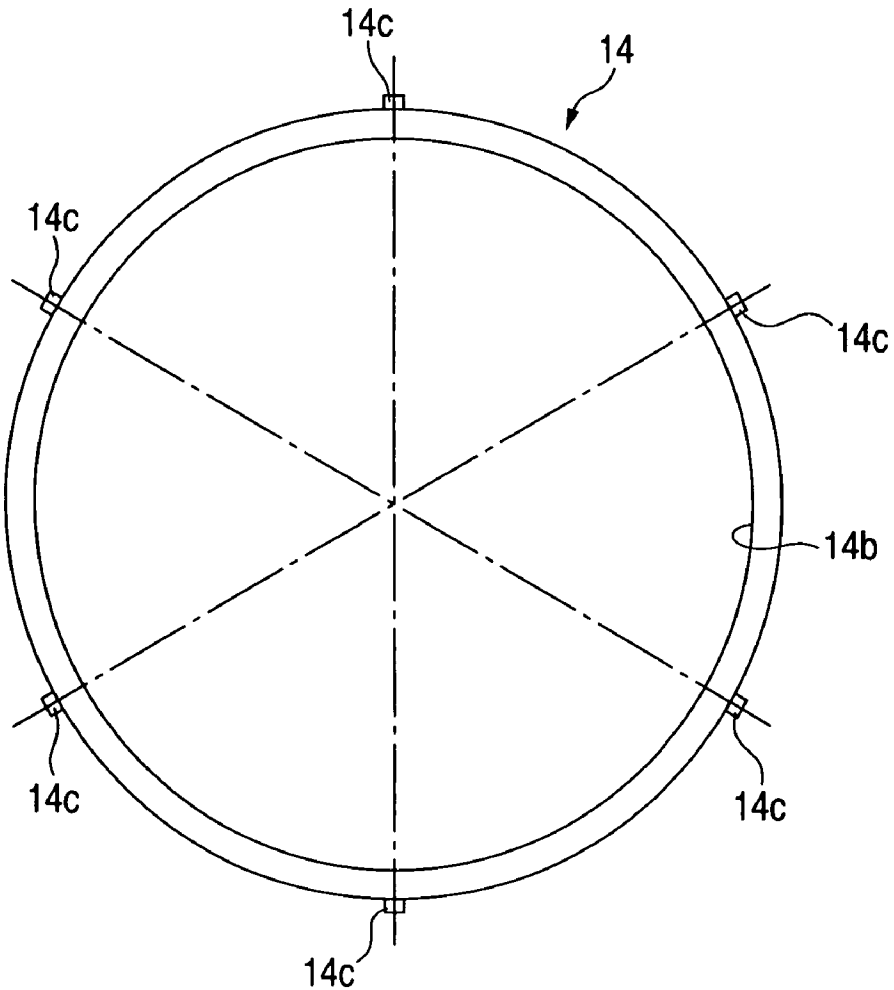

FIGS. 13A and 13B are explanatory drawings of the cylindrical connecting member, in which FIG. 13A is a cross-sectional side view, and FIG. 13B is a drawing when viewed in the direction indicated by an arrow XIIIB in FIG. 13A.

In FIG. 11 and FIGS. 13A and 13B, the cylindrical connecting member 14 is a cylindrical member, and includes a cylindrical insertion portion 14*a* to be inserted into an opening 12*c* of the container body 12 at the right end of FIG. 13A, and a small-inner diameter portion (closing-lid-side connecting portion) 14*b* is provided at the left end (outer end), and six engaging portions (container-body-side connecting portion) 14*c* in total are projected from the outer peripheral surface of the intermediate portion at the angular intervals of 60 degrees.

In FIG. 11, the opening 15*c* of the resilient thin wall container 15 is fitted on the outer peripheral surface of the cylindrical insertion portion 14*a* and fixed by ultra sonic welding (heat welding). In this state, the resilient thin wall container 15 is inserted into the container body 12, the cylindrical insertion portion 14*a* is loosely press-fitted to the inner peripheral surface of the opening 12A1 of the container body 12 and, simultaneously, six engaging portions 14*c* in total are inserted into the engaging grooves 12A3 (see FIG. 12D and FIG. 12E) of the engaging groove forming member 12A2. The cylindrical connecting portion 14 is twisted with respect to the container body 12 in this state so as to engage the engaging portions 14*c* with the portion extending circumferentially of the inner ends of the engaging grooves 12A3 (see FIG. 12D). In this state, the container body 12, the cylindrical connecting member 14, and the resilient thin wall container 15 are connected (see FIG. 9).

Figure 14A:
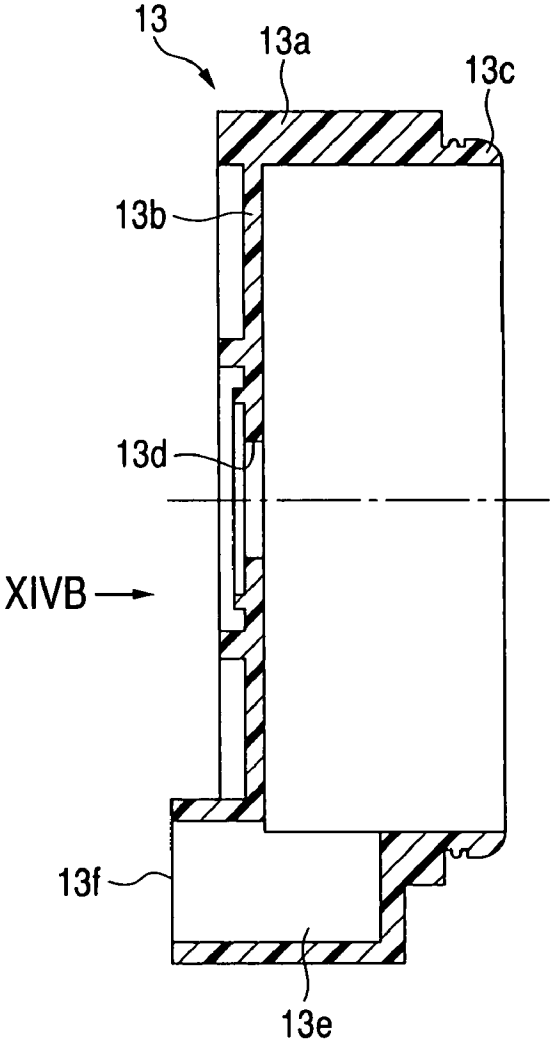
Figure 14B:
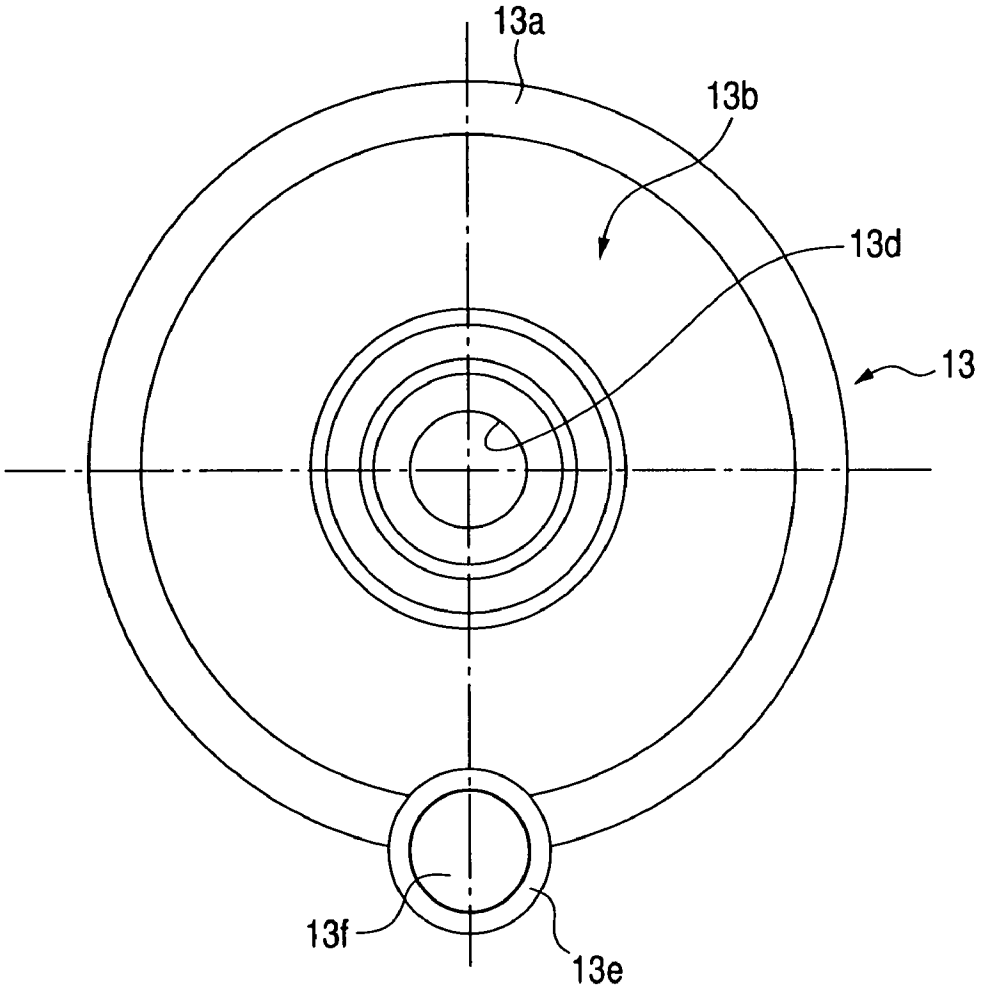

FIGS. 14A and 14B are explanatory drawings of the closing lid, in which FIG. 14A is a cross-sectional side view of the closing lid, FIG. 14B is a drawing when viewed in the direction indicated by an arrow XIVB in FIG. 14A.

In FIG. 14A and FIG. 11, the closing lid 13 includes a cylindrical wall 13*a* and an end wall 13*b* connected to the left end thereof. The cylindrical wall 13*a* includes the cylindrical insertion portion (detachable portion) 13*c* having projections and recesses on the outer peripheral surface at the right end thereof. The end wall 13*b* is formed with a coupler through hole (coupler mounting portion) 13*d* at the center thereof, and a developer discharge tube 13*e* is integrally formed with the lower end thereof. A developer discharge port 13*f* is formed at the outer end of the developer discharge tube 13*e*.

As is seen from FIG. 9 and FIG. 11, the cylindrical insertion portion 13*c* is loosely press-fitted into the interior through the small inner diameter portion 14*b* of the cylindrical connecting member 14 and connected thereto.

In other words, in FIG. 11, the cylindrical insertion portion 14*a* to which the opening 15*c* of the resilient thin wall container 15 is mounted and welded is loosely press-fitted through the opening 12A1 into the interior of the container body 12, and the engaging portions 14*c* and the engaging grooves 12A3 are engaged, so that the container body 12 and the cylindrical connecting member 14 are connected. The cylindrical insertion portion 13*c* of the closing lid 13 is inserted into the small inner diameter portion 14*b* to connect the cylindrical connecting member 14 and the closing lid 13. In other words, according to the first embodiment, the container body 12 and the closing lid 13 are indirectly connected via the cylindrical connecting member 14.

The connecting structure between the cylindrical insertion portion 13*c* and the small inner diameter portion 14*b* may be such that connection can be easily be performed by connecting the closing lid 13 and the cylindrical connecting member 14, and the small inner diameter portion 14*b* is broken when disconnecting the closing lid 13 and the cylindrical connecting member 14 in the connected state. The structure in this case may be such that, for example, a plurality of claws projecting inwardly are formed at a plurality of positions of the smaller inner diameter portion 14*b* at intervals in the circumferential direction, and the claws are adapted to be deformed resiliently when connecting the closing lid 13 and the cylindrical connecting member 14 to facilitate connection between the closing lid 13 and the cylindrical connecting member 14. However, the claws provided on the small inner diameter portion 14*b* may be adapted to be broken when disconnecting the closing lid 13 and the cylindrical connecting member 14 in the connected state.

In this case, the cylindrical connecting member 14 is absolutely broken when the cylindrical connecting member 14 is disconnected from the closing lid 13 for recycling the spent developer cartridge container 11. In such a case, the cylindrical connecting member 14 cannot be reused, and thus a new cylindrical connecting member 14 is used when reusing the developer cartridge container 11.

In this arrangement, in order to collect the spent developer cartridge Ky and recycle them for selling. as a new product, a new cylindrical connecting member 14 is required. In this case, since the third party can hardly be able to collect the used developer cartridge Ky and recycle it for resale, circulation of a number of recycled low-quality developer cartridges Ky in the market may be prevented.

Figure 15A:
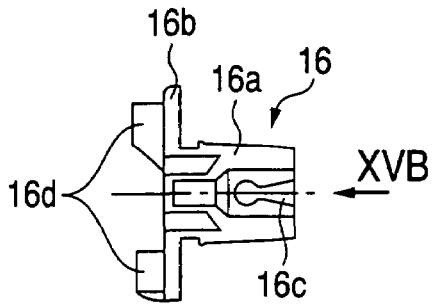
Figure 15B:
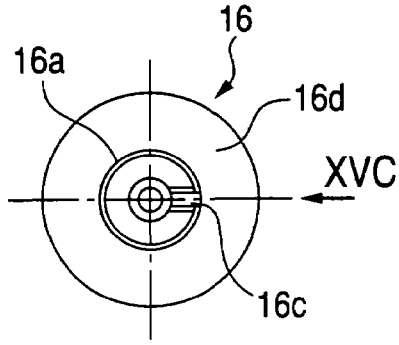
Figure 15C:
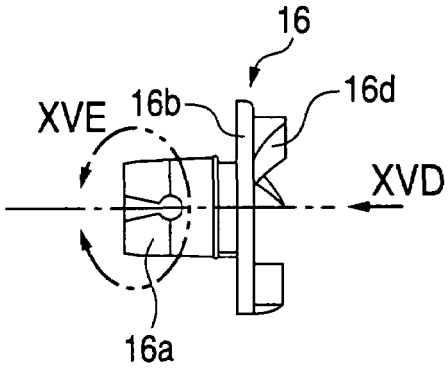
Figure 15D:
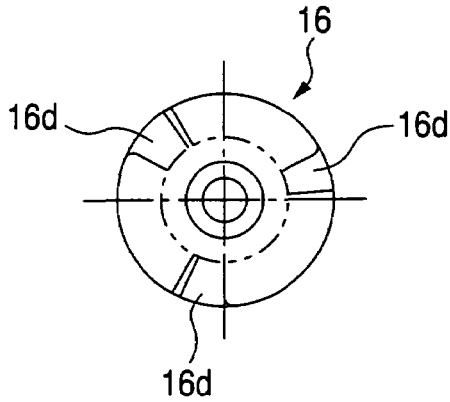
Figure 15E:
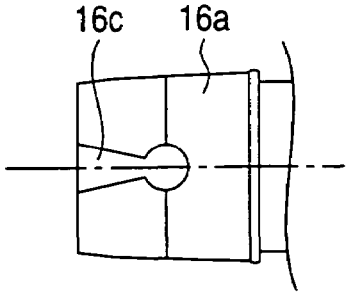
Figure 15F:
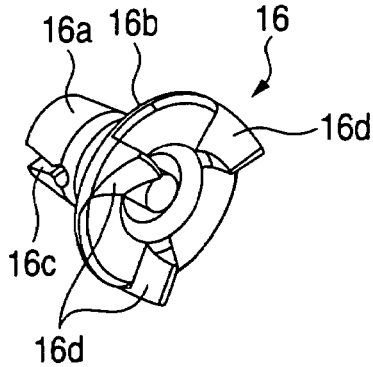

FIGS. 15A to 15F are explanatory drawings of a coupler to be detachably mounted to the closing lid, in which FIG. 15A is a cross-sectional side view, FIG. 15B is a drawing when viewed in the direction indicated by an arrow XVB in FIG. 15A, FIG. 15C is a drawing when viewed from the direction indicated by an arrow XVC in FIG. 15B, FIG. 15D is a drawing when viewed in the direction indicated by an arrow XVD in FIG. 15C, FIG. 15E is an enlarged drawing of the portion indicated by an arrow XVE in FIG. 15C, and FIG. 15F is a perspective view of a coupler.

In FIGS. 15A to 15F, the coupler 16 includes a cylindrical portion 16*a*, and a plate member 16*b* to be connected to the outer end of the cylindrical portion 16*a*. A mixing member connecting portion 16*c* is formed at the inner end of the cylindrical portion 16*a*. The mixing member 18 is detachably connected to the mixing member connecting portion 16*c*.

A plurality of engaging claws 16*d* are integrally formed on the outer surface of the plate member 16*b*. A rotational force from the engaging claws of the drive coupler 5 (see FIG. 3) is transmitted to the engaging claws 16*d*.

Figure 16C:
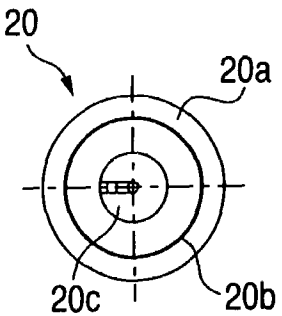
Figure 16A:
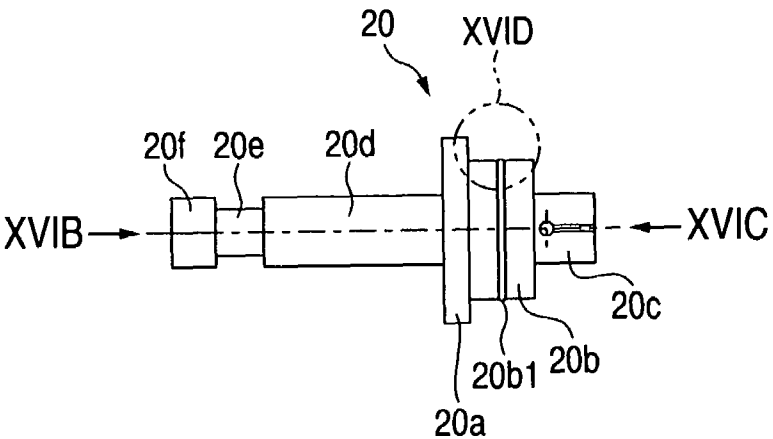
Figure 16D:
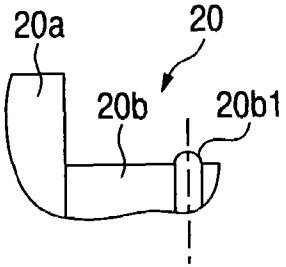
Figure 16B:
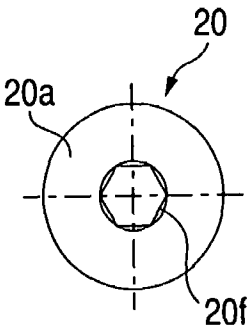

FIGS. 16A to 16D are explanatory drawings of the connecting member for transmitting a rotational force to the developer discharging auger, in which FIG. 16A is a side view, FIG. 16B is a drawing when viewed in the direction indicated by an arrow XVIB in FIG. 16A, FIG. 16C is a drawing when viewed in the direction indicated by an arrow XVIC in FIG. 16A, and FIG. 16D is an enlarged view of the portion indicated by an arrow XVID in FIG. 16A.

In FIGS. 16A to 16D, the discharge port opening-closing member 20 includes a center flange 20*a*, a fitting portion 20*b* on the right side thereof, an auger connecting portion 20*c* provided on the right end (inner end) thereof, and a shaft portion 20*d* projecting from the center flange portion 20*a* toward the left. A small diameter portion 20*e* is provided at the axial outer end of the shaft 20*d*, and a polygonal column portion having a hexagonal cross section (connecting portion for transmitting a rotational force) 20*f* is provided at the outer end (left end) thereof. A ring-shaped projection 20*b*1 is provided on the outer peripheral surface of the fitting portion 20*b*.

As shown in FIGS. 4A and 4B, the outer end of the developer discharge auger 19 formed of the coil spring is connected to the auger connecting portion 20*c*. The outer diameter of the ring-shaped projection 20*b*1 is formed to a size which fits to the inner peripheral surface of the developer discharge tube 13*e* (see FIGS. 14A and 14B) of the closing lid 13. The polygonal column portion 20*f* is a portion to be fitted and connected detachably to the shaft fitting hole GSa having a hexagonal cross section of the gear G5 (See FIGS. 4A, 4B, 5A and 5B).

(Operation of the First Embodiment)

In the developer cartridge of the image forming unit according to the first embodiment of the present invention having the structure described above, the cylindrical insertion portion 14*a* of the cylindrical connecting member 14 shown in FIG. 8 is inserted into the opening 15*c* of the resilient thin wall container 15, and the cylindrical insertion portion 14*a* and the opening 15*c* are heat welded. Then, the resilient thin wall container 15 is inserted into the container body 12 of the rigid developer cartridge container 11, the cylindrical insertion portion 14*a* to which the opening 15*c* is heat welded is loosely press-fitted into the interior through the opening 12A1 of the container body 12 and simultaneously, the engaging portions 14*c* are inserted into the engaging grooves 12A3 (see FIG. 12D and FIG. 12E). The cylindrical connecting member 14 is twisted with respect to the container body 12 in this state so as to engage the engaging portions 14*c* with the portions extending in the circumferential direction of the inner ends of the engaging grooves 12A3 and connect the container body 12, the cylindrical connecting member 14, and the resilient thin wall container 15. In this manner, the components indicated by the reference numerals 12, 14, and 15 are assembled into the container body unit (12+14+15).

As shown in FIG. 8 and FIG. 9, the seat member 17 is adhered to the inner surface of the closing lid 13, and the coupler 16 is mounted to the closing lid 13 in the state of being passed through the coupler through hole 13*d*. Then the mixing member 18 is connected to the inner end of the coupler 16. The developer discharging auger 19 connected to the discharge port opening-closing member 20 is inserted into the developer discharge tube 13*e* and the discharge port opening-closing member 20 is inserted into the developer discharge tube 13*d* as shown in FIGS. 4A, 4B and FIG. 9. At this time, the developer discharging auger 19 formed of a coil spring is maintained in the compressed state.

In this manner, the components represented by the reference numerals 13 and 16–20 are assembled into the closing lid unit (13+16–20).

Developer is filled in the resilient thin wall container 15 of the container body unit (12+14+15). Since such filling of developer is performed through a large inner hole of the cylindrical connecting member 14, the filling operation can easily be performed.

In order to assemble the closing lid unit (13+16–20) to the container body unit (12+14+15) filled with the developer, the mixing member 18 is screwed into developer in the resilient thin wall container 15 while rotating the mixing member 18. Then the cylindrical insertion portion 13*c* of the closing lid 13 (see FIG. 14A) is loosely press-fitted into the small inner diameter portion 14*b* of the cylindrical connecting member 14 to connect the cylindrical connecting member 14 and the closing lid 13. In other words, according to the first embodiment, the container body 12 and the closing lid 13 are connected indirectly via the cylindrical connecting member 14.

As described above, the container body unit (12+14+15) filled with developer in the resilient thin wall container 15 and the closing lid unit (13+16–20) are assembled to manufacture the developer cartridge Ky.

The state in which the developer cartridge Ky is inserted into the cartridge mounting member Hy in FIG. 3 is shown in FIGS. 4A and 4B. In the state shown in FIGS. 4A and 4B, the solenoid 6*d* (see FIG. 4B, FIG. 5B, and FIG. 6A) of the disconnecting member 6 (see FIGS. 6A to 6C) is in the OFF state. The solenoid 6*d* is OFF when the power source of the image forming unit (see FIG. 1) is OFF, and is ON when the power source of the image forming unit U is ON. In the state shown in FIG. 4B, the small diameter portion 20*e* of the discharge port opening-closing member 20 is disposed at the position opposing the front end (forward end) of the operating lever 6*j* of the disconnecting member 6 and in adjacent thereto.

When the solenoid 6*d* is turned ON in the state shown in FIG. 4B, the disconnecting member 6 moves forward so that the pair of levers 6*j*1 and 6*j*1 (see FIGS. 6A to 6C) of the operating lever 6*j* sandwiches the small diameter portion 20*e* of the discharge port opening-closing member 20 and rotates about the hinge pin 6*i* (see FIGS. 6A to 6C), and assumes the state shown in FIG. 5B. In the state shown in FIG. 5B, the discharge port opening-closing member 20 is disconnected from the developer discharge cylinder 13*e*, and the polygonal column portion 20*f* at the outer end of the discharge port opening-closing member 20 is fitted into the shaft fitting hole G5*a* of the gear G5, being hexagonal in cross section. The developer discharging auger 19 formed of a coil spring in the developer discharge tube 13*e* assumes the extended state shown in FIGS. 5A and SB from the compressed state shown in FIGS. 4A and 4B. At this time, developer in the developer discharge tube 13*e* is fluidized, and hence its flowing property is improved. In a state in which the discharge port opening-closing member 20 is disconnected from the developer discharge pipe 13*e*, the discharge port opening-closing member 20 rotates integrally with the gear G5.

In other words, when a rotational force is transmitted to the gear G1 by a rotating unit, not shown, the gear G5 (see FIG. 4A) and the gear G3 (see FIG. 3) which mesh with the gear G1 rotate, and the gears G4 and G2 also rotate.

The mixing members 1*e* and 1*f*, and the discharging member 1*g* shown in FIG. 3 rotates as the gears G1 to G5 rotate, and the mixing member 18 and the developer discharging auger 19 shown in FIG. 4A and FIG. 7 rotate. In this case, developer in the resilient thin wall container 15 flows through the developer intake port 1*d* (see FIG. 2 and FIG. 4A) from the developer discharge tube 13*e* into the developer mixing container 1Y. Developer flown into the developer mixing container 1Y is mixed in the developer mixing container 1Y, and then replenished from the discharge port 1*c* (see FIG. 2) of the discharge cylinder 1*b* through the developer replenishing path 2*k* (FIG. 2) to the developing unit Gy.

In the first embodiment, when the power source of the image forming unit U is OFF, the solenoid 6*d* is turned OFF. Since the resilient force of the compression string 6*h* (see FIGS. 6A to 6C) is set to a large value in comparison with the resilient force of the developer discharging auger 19, when the solenoid 6*d* is turned OFF, the operating lever 6*j* is retracted while rotating by the compression spring Gh of the disconnecting member 6. The discharge port opening-closing member 20 moves from a position shown in FIGS. 5A and 5B to a position shown in FIG. 4A and 4B by the movement of the operating lever 6*j* by the compression spring 6*h*, and inserted into the developer discharge tube 13*e*.

In other words, in the first embodiment, when the power source of the image forming unit U is ON, the discharge port opening-closing member 20 is connected to the gear G5, and when the power source of the image forming unit U is OFF, the discharge port opening-closing member 20 assumes a state of being inserted into the developer discharge tube 13*e*.

When developer in the developer cartridge Ky is spent completely, the developer cartridge Ky is disconnected from the cartridge mounting member Hy. In this case, since the discharge port opening-closing member 20 assumes a state of being inserted into the developer discharge tube 13*e*, developer is prevented from flying in all directions from the developer cartridge Ky disconnected from the cartridge mounting member Hy.

The spend developer cartridge Ky disconnected from the cartridge mounting member Hy is first disassembled into the container body unit (12+14+15) and the closing lid unit (13+16–20).

Then, the container body unit (12+14+15) is disassembled into the container body 12, the cylindrical connecting member 14, and the resilient thin wall container 15 welded to the cylindrical insertion portion 14*a* of the cylindrical connecting member 14.

Since the cylindrical connecting member 14 and the resilient thin wall container 15 are welded, the resilient thin wall container 15 is broken when disassembled, and thus it cannot be reused. Therefore, since the resilient thin wall container 15 cannot be reused, it is recycled as material for different parts. However, there is a case in which the cylindrical connecting member 14 can be reused, and in such case, it is reused. When it cannot be reused, it is recycled as material for different parts. The container body 12 is washed and reused.

Since the container body 12 does not come into direct contact with developer, it is not stained so much, and thus it can easily be washed. Since the cylindrical connecting member 14 is also compact, the stain can be removed easily by air-washing.

The closing-lid-side connecting portion 14*b* of the cylindrical connecting member 14 may be adapted to be broken when disconnected after having connected to the closing lid 13 so that it cannot be reused.

According to the first embodiment, the closing lid unit (13+16–20) is first disassembled into a member having the closing lid 13 to which the seat member 17 is welded, the coupler 16 and the mixing member 18, and a member having the developer discharging auger 19 and the discharging port opening-closing member 20, and then air-washed for reuse. Since the disassembled components (13+17), 16, 18, 19, and 20 are small, stain may easily be removed by air-washing.

Second Embodiment

Figure 17A:
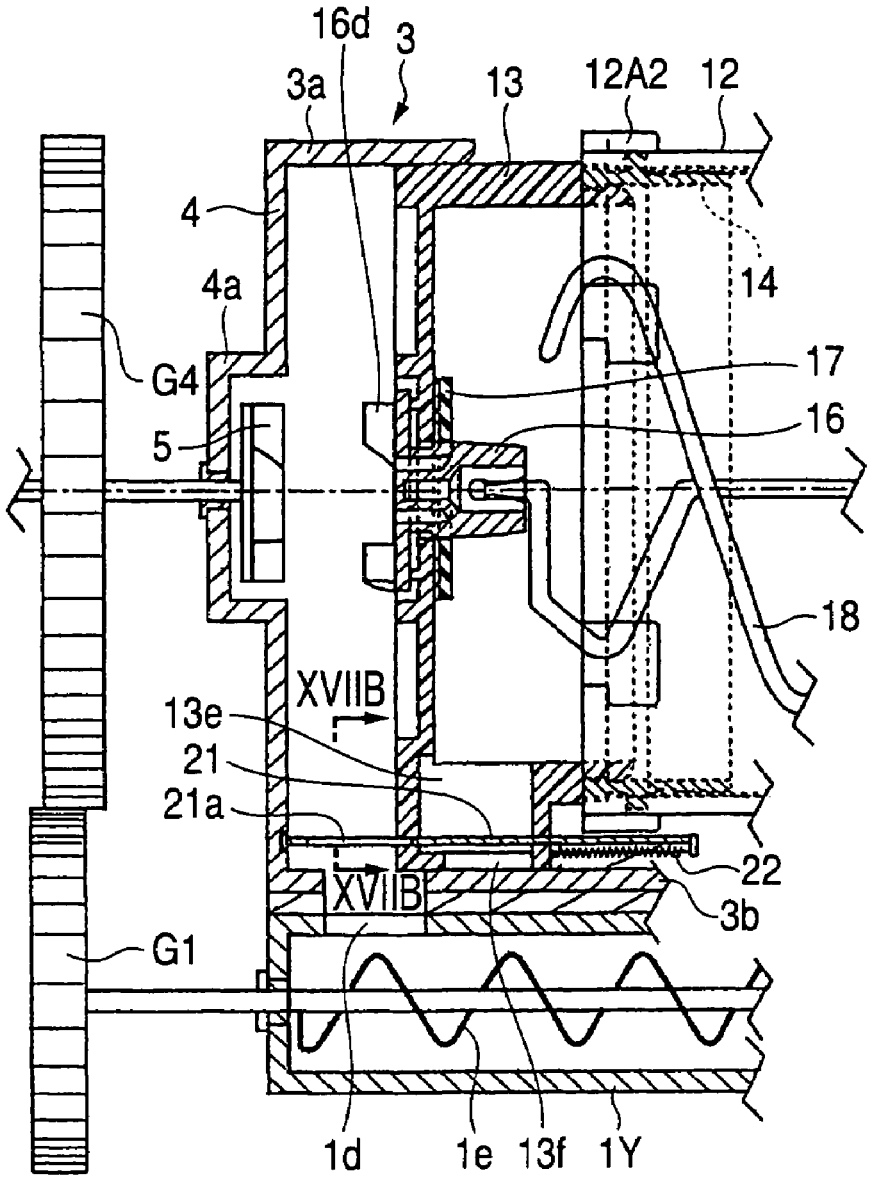
FIG. 17A is a side view.
Figure 17B:
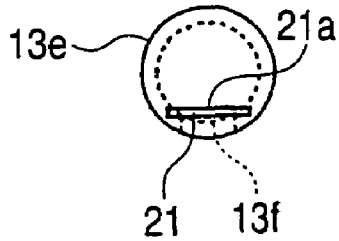

FIGS. 17A and 17B are explanatory drawings of the developer cartridge according to a second embodiment of the present invention, in which FIG. 17A is a drawing showing a state immediately before completion of mounting of the developer cartridge to the cartridge-mounting member, and FIG. 17B is a drawing when viewed in the direction indicated by an arrow XVIIB—XVIIB in FIG. 17A.

Figure 18:
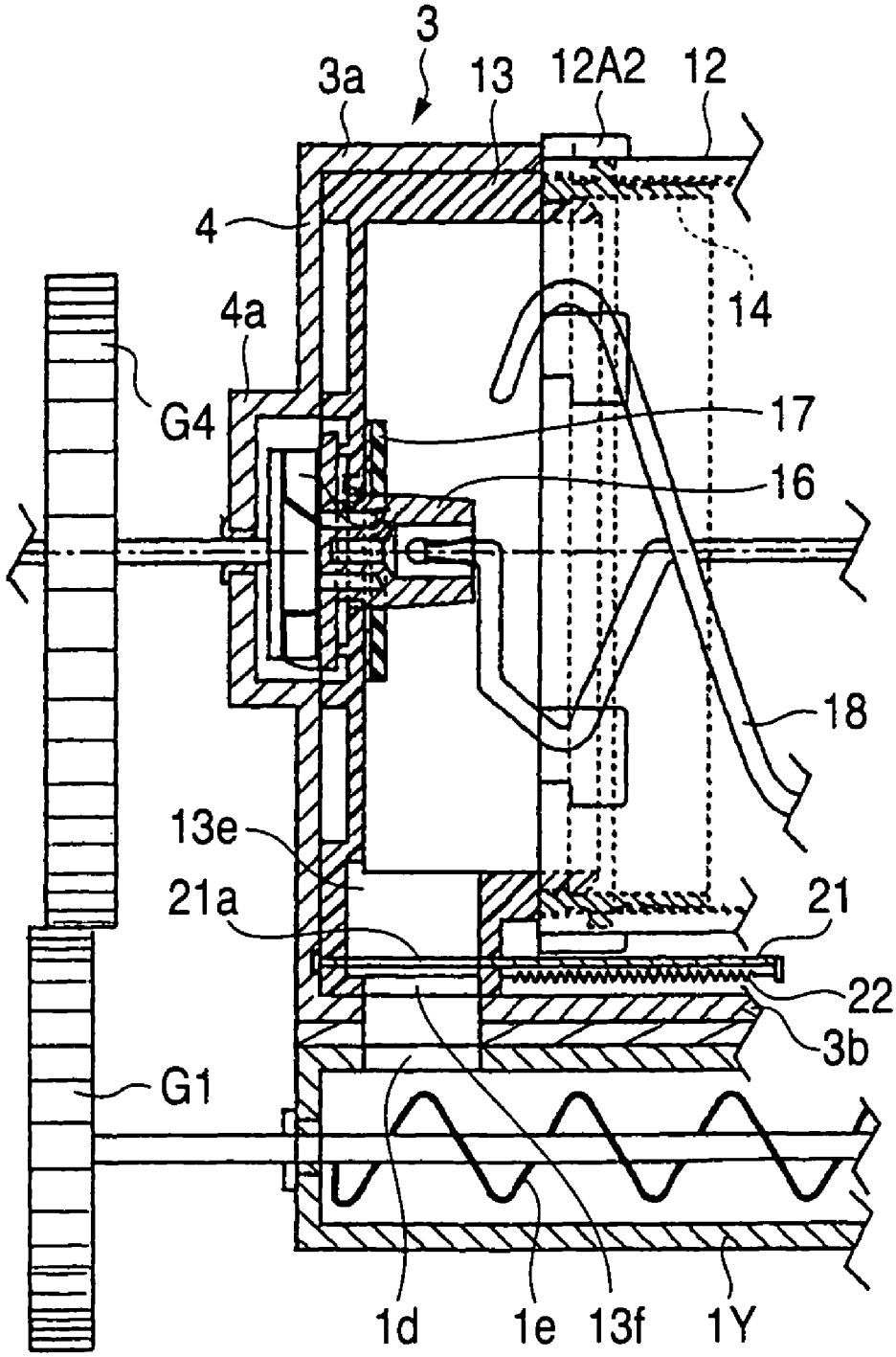
FIG. 18 is an explanatory drawing of the developer cartridge according to the second embodiment of the present invention, showing a state in which the developer cartridge is mounted to the cartridge mounting member, which corresponds to FIGS. 5A and 5B in the first embodiment.

FIG. 18 is an explanatory drawing of the developer cartridge according to the second embodiment of the present invention, showing a state in which the developer cartridge is mounted to the cartridge mounting member, which corresponds to FIGS. 5A and 5B in the first embodiment.

In the description of the second embodiment, the same parts corresponding to the parts in the first embodiment are represented by the same reference numerals, and detailed description will be omitted.

Though the second embodiment is different from the first embodiment in the following points, it has otherwise the same structure as the first embodiment in other points.

In FIGS. 17A and 17B and FIG. 18, the developer discharge tube 13*e* of the second embodiment is shorter in the axial direction; and the developer discharge port 13*f* is formed on the lower surface of the developer discharge tube 13*e*. A plate shaped shutter 21 extending in the axial direction is passed through the lower portion of the developer discharge tube 13*e* so as to be slidable in the axial direction.

The right end of the shutter 21 passes through the right end wall of the developer discharge tube 13*e* and projects rightward. A tension spring 22 is provided between the right end of the shutter 21 and the right end wall of the developer discharge tube 13*e*, and the shutter 21 is maintained in a state of being constantly moved leftward.

The shutter 21 is formed with an opening 21*a*, and the opening 21*a* is arranged at a position projected outwardly of the left end wall of the developer discharge tube 13*e* in the state shown in FIG. 17A. In the state shown in FIG. 17A, developer above the shutter 21 cannot be moved below the shutter 21.

In the state shown in FIG. 18, the left end of the shutter 21 comes into contact with the rear end wall 4 of the cartridge mounting member Hy, the opening 21*a* of the shutter 21 moves rightward from the state shown in FIG. 17A into the interior of the developer discharge tube 13*e*. In this state, developer above the shutter 21 can pass through the opening 21*a* downward. In FIG. 18, developer moved through the opening 21*a* downward passes from the developer discharge port 13*f* through the developer inlet port 1*d* and flows into the interior of the developer mixing unit 1Y.

According to the second embodiment, the shutter 21 assumes the opened state when the developer cartridge Ky is mounted to the cartridge mounting member Hy (the state shown in FIG. 18), and developer can be supplied into the developer mixing container 1Y. However, when the developer cartridge Ky is disconnected from the cartridge mounting member Hy, the shutter 21 is automatically closed by the tension spring 22, and developer in the developer cartridge Ky is prevented from flying in all directions.

Other structures and operations of the second embodiment are the same as the first embodiment.

Third Embodiment

Figure 19:
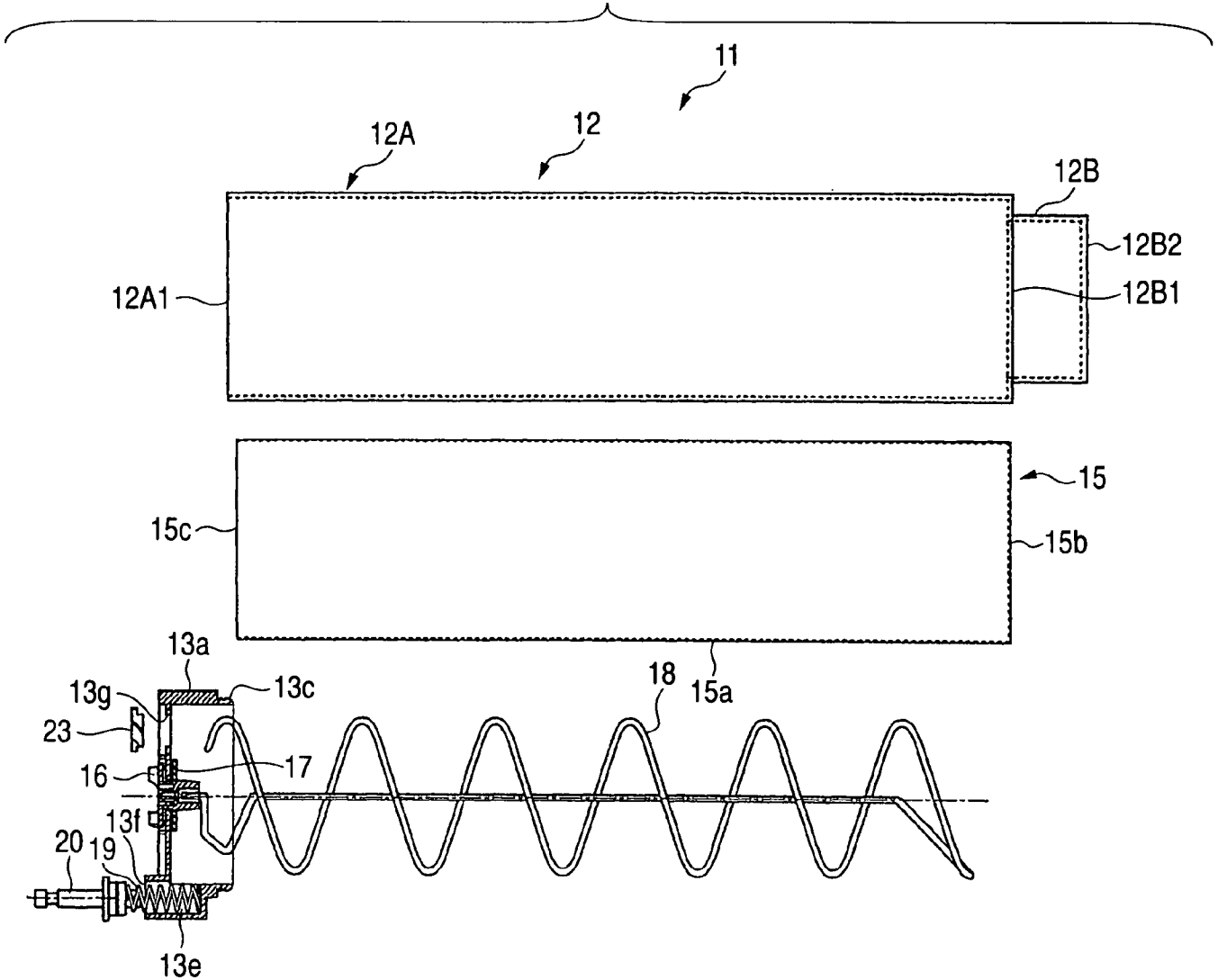
FIG. 19 is an exploded explanatory drawing of the entire developer cartridge according to a third embodiment of the present invention.

FIG. 19 is an exploded explanatory drawing of the entire developer cartridge according to a third embodiment of the present invention.

Figure 20:
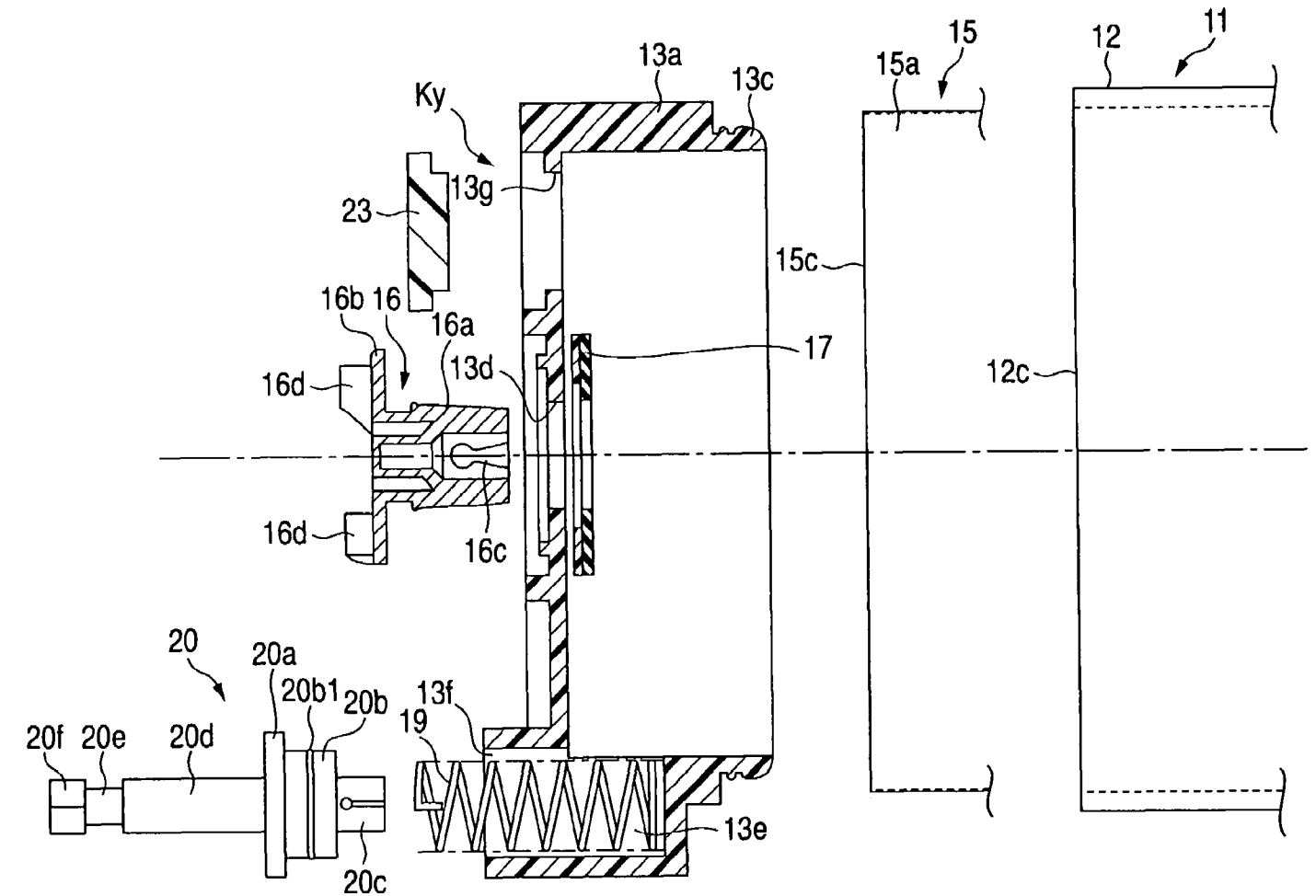
FIG. 20 is an enlarged exploded drawing of the principal portion of the developer cartridge according to the third embodiment of the present invention.

FIG. 20 is an enlarged exploded drawing of the principal portion of the developer cartridge according to the third embodiment of the present invention.

In the description of the third embodiment, the same parts corresponding to the parts in the first embodiment are represented by the same reference numerals, and detailed description will be omitted.

Though the third embodiment is different from the first embodiment in the following points, it has otherwise the same structure as the first embodiment in other points.

As shown in FIG. 19 and FIG. 20, in the developer cartridge Ky of the third embodiment, the cylindrical connecting member 14 shown in FIG. 8 and FIG. 11 in conjunction with the first embodiment is omitted, and the engaging groove forming members 12A2 and the engaging grooves 12A3 of the container body 12 are also omitted.

The opening 15*c* of the resilient thin wall container 15 of the third embodiment is mounted and welded to the outer peripheral surface of the cylindrical insertion portion 13*c* of the closing lid 13. An opening (filling port) 13*g* is formed on the end wall 13*b* of the closing lid 13. The opening 13*g* is closed by a detachable lid 23.

In the third embodiment of the structure described above, the resilient thin wall container 15 and the cylindrical insertion portion 13*c* are inserted into the container body 12 in a state in which the opening 15*c* of the resilient thin wall container 15 is mounted to the cylindrical insertion portion 13*c* of the closing lid 13. In this case, the closing lid 13 and the container body 12 are detachably connected by loosely press-fitting the cylindrical insertion portion 13*c* to the inner peripheral surface of the opening 12A1 of the container body 12. Therefore, in this case, the cylindrical insertion portion 13*c* of the closing lid 13 is also serves as the detachable portion 13*c* detachably connected to the container body 12.

Developer is filled through the opening 13*g* of the closing lid 13 in a state in which the container body 12 and the closing lid 13 are connected.

In the developer cartridge Ky of the third embodiment, since the opening 15*c* of the resilient thin wall container 15 is welded to the outer peripheral surface of the cylindrical insertion portion 13*c*, when disassembled after use, the opening 15*c* of the resilient thin wall container 15 is broken by disassembling the resilient thin wall container 15 from the cylindrical insertion portion 13*c* of the closing lid 13. Therefore, the resilient thin wall container 15 cannot be reused and thus is recycled as material for different parts. However, the closing lid 13 is used if it is in the reusable state when the resilient thin wall container 15 is disassembled, and if it is not in the reusable state, it is recycled as material for different parts. The container body 12 and other parts are washed and then reused.

Fourth Embodiment

Figure 21:
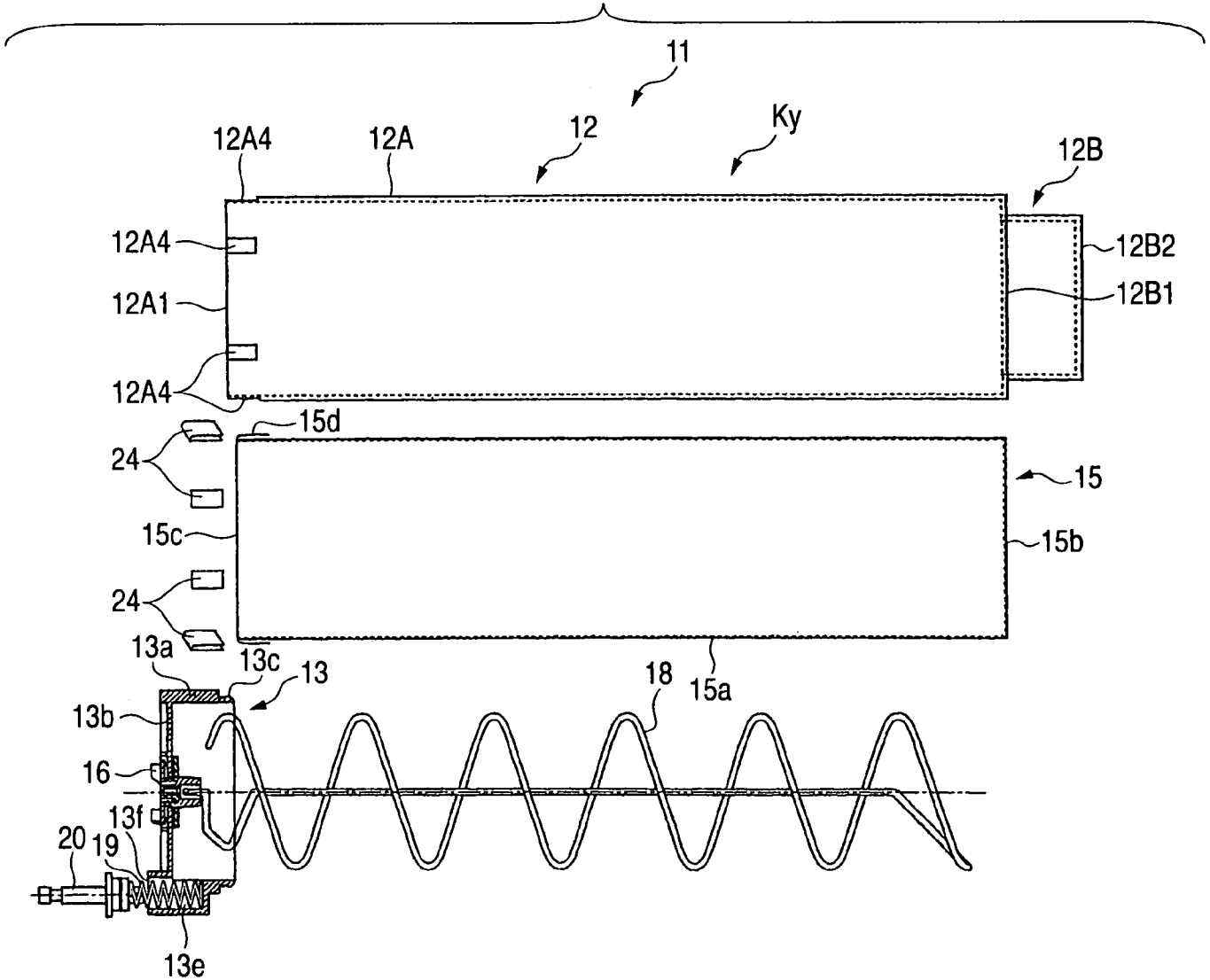
FIG. 21 is an exploded explanatory drawing showing the entire developer cartridge according to the fourth embodiment of the present invention.

FIG. 21 is an exploded explanatory drawing showing the entire developer cartridge according to the fourth embodiment of the present invention.

Figure 22:
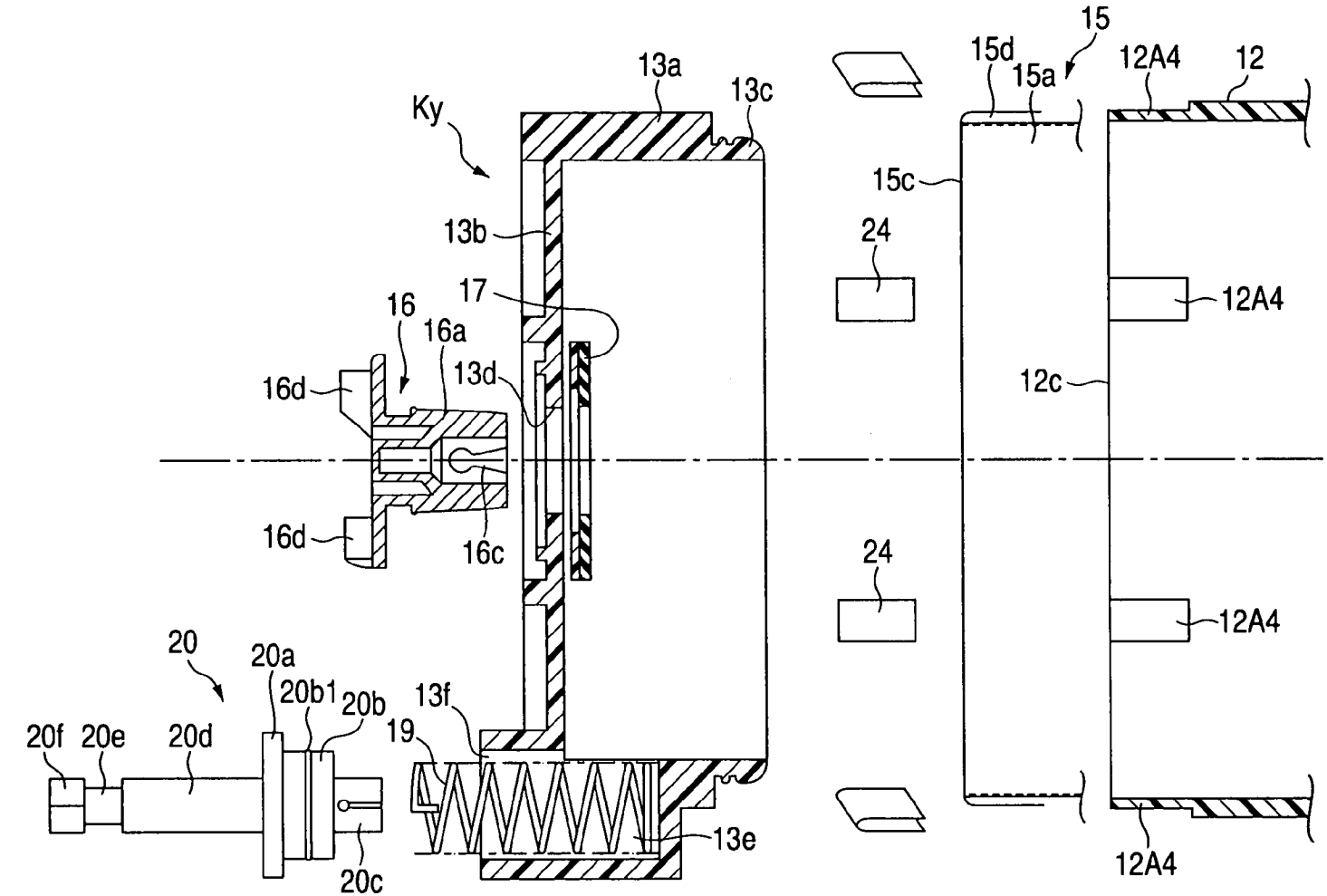
FIG. 22 is an exploded enlarged drawing showing the principal portion of the developer cartridge according to the fourth embodiment of the present invention.

FIG. 22 is an exploded enlarged drawing showing the principal portion of the developer cartridge according to the fourth embodiment of the present invention.

In the description of the fourth embodiment, the same parts corresponding to the parts in the first embodiment are represented by the same reference numerals, and detailed description will be omitted.

Though the fourth embodiment is different from the first embodiment in the following points, it has otherwise the same structure as the first embodiment in other points.

As shown in FIG. 21 and FIG. 22, in the developer cartridge Ky according to the fourth embodiment, the cylindrical connecting member 14 shown in FIG. 8 and FIG. 11 in conjunction with the first embodiment is omitted, and the engaging groove forming members 12A2 and the engaging grooves 12A3 of the container body 12 are also omitted, and clip mounting portions 12A4 which are formed by partly reducing the thickness are provided on the outer peripheral surface of the container body 12 at angular intervals of 60 degrees in the circumferential direction.

An outwardly bent portion 15*d* bent outward is provided at the opening 15*c* of the resilient thin wall container 15.

The outwardly bent portion 15*d* is arranged by bending so as to cover the outer peripheral surface of the opening 12*c* of the container body 12 in a state in which the resilient thin wall container 15 is inserted into the container body 12. In this state, a clip 24 of U-shape in cross section is mounted from the outside of the resilient thin wall container 15 to the clip mounting portion 12A4 of the opening 12A1.

The clip 24 is used as an opening fixing member 24 for fixing the opening 15*c* of the resilient thin wall container 15 to the opening 12A1 of the container body 12.

In this state, developer is filled into the resilient thin wall container 15, and then the cylindrical insertion portion 13*c* of the closing lid 13 is inserted into the opening 12A1 of the container body 12. In this case, the container body 12 and the closing lid 13 are detachably connected by loosely press-fitting the cylindrical insertion portion 13*c* to the inner peripheral surface of the opening 12A1 of the container body 12.

In the developer cartridge Ky of the fourth embodiment, since the opening 15*c* of the resilient thin wall container 15 is fixed to the clip mounting portions 12A4 of the container body 12 by the clips 24, when disassembling the container body 12 and the resilient thin wall container 15 after use, it can easily be disassembled by removing the clips 24. Since the resilient thin wall container 15 is significantly stained and thus difficult to wash off, it is not reused, and is recycled as material for different parts. However, the container body 12 and other parts are washed and then reused.

Fifth Embodiment

Figure 23:
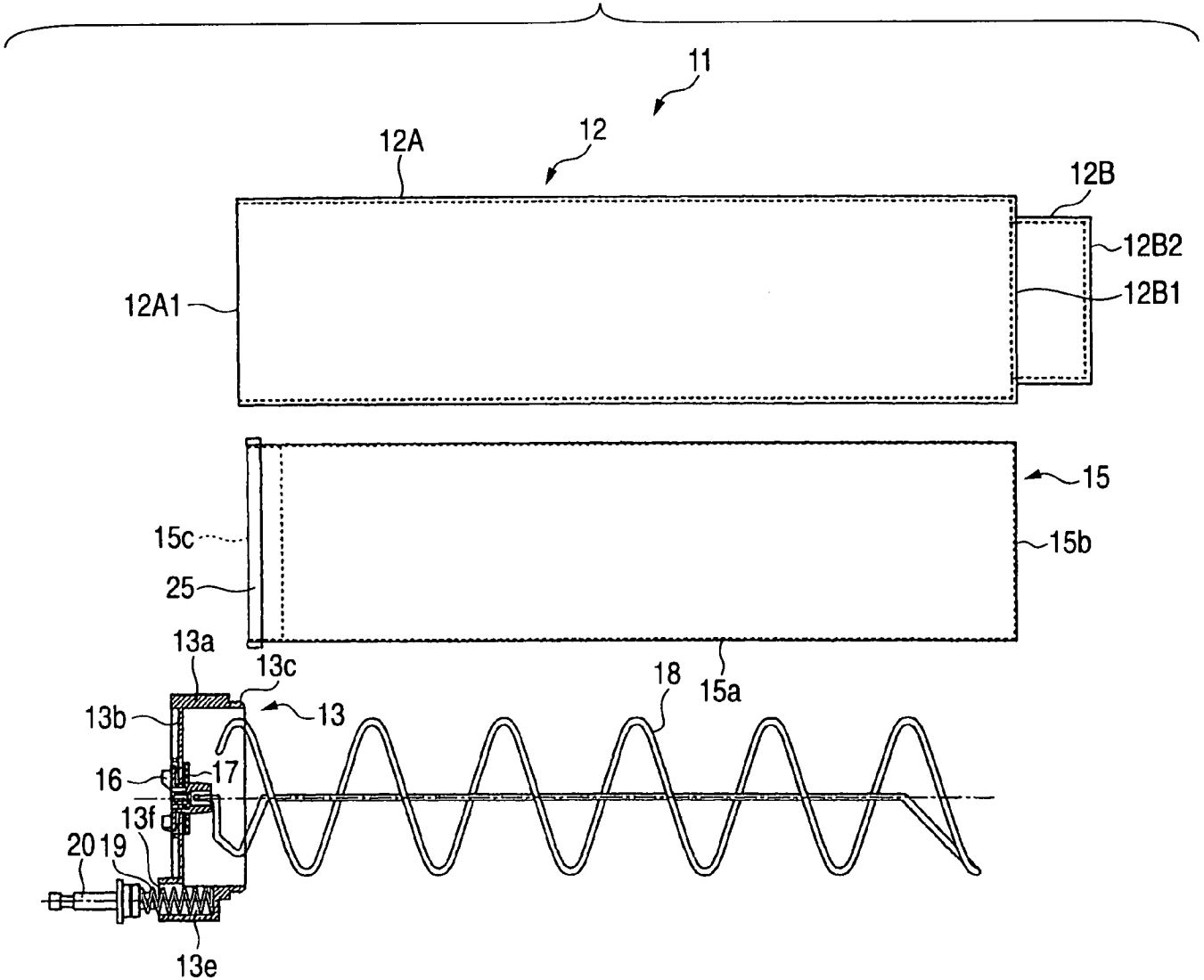
FIG. 23 is an exploded explanatory drawing of the entire developer cartridge according to a fifth embodiment of the present invention.

FIG. 23 is an exploded explanatory drawing of the entire developer cartridge according to a fifth embodiment of the present invention.

Figure 24:
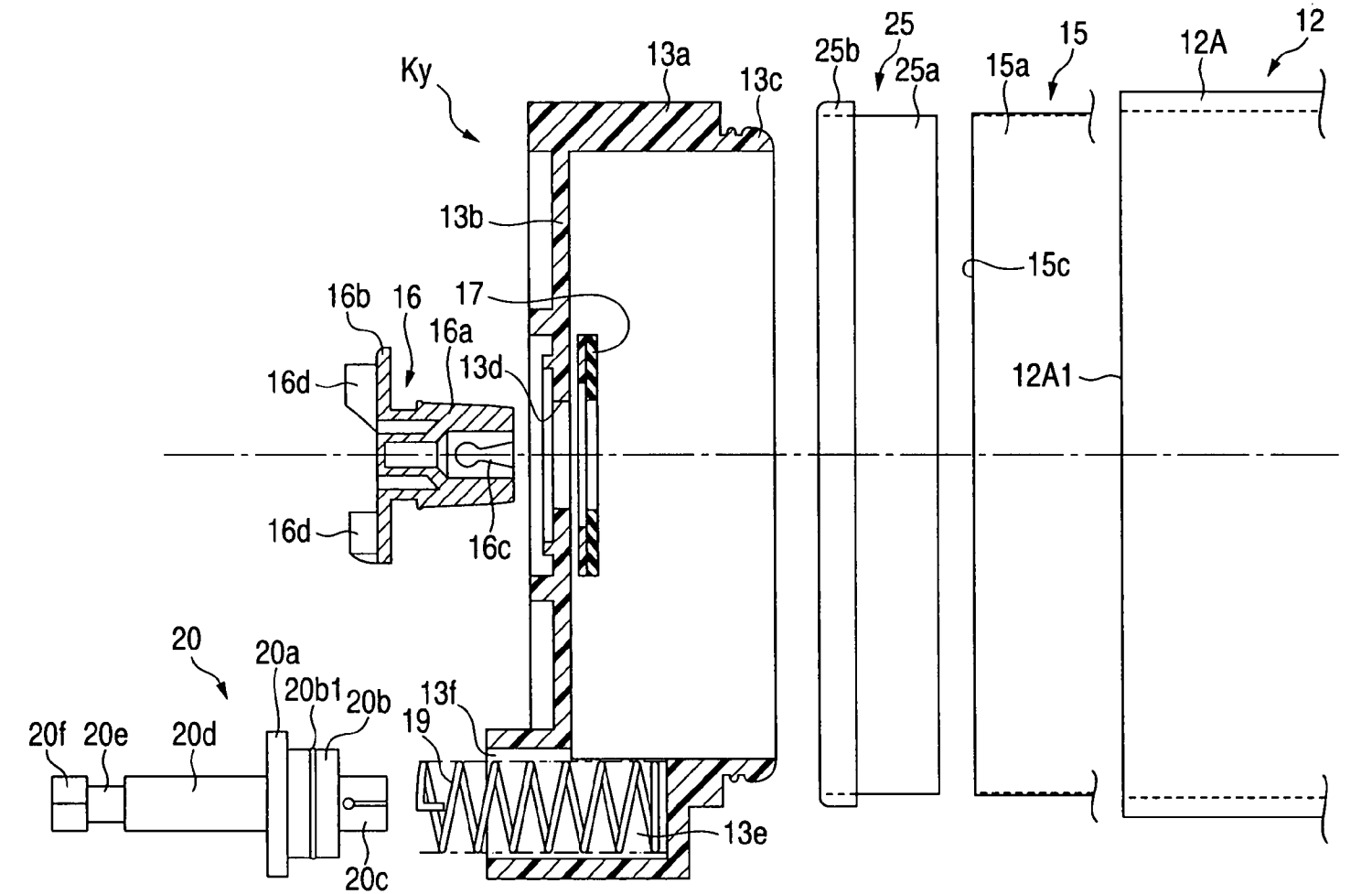
FIG. 24 is an exploded enlarged drawing of the principal portion of the developer cartridge according to the fifth embodiment of the present invention.

FIG. 24 is an exploded enlarged drawing of the principal portion of the developer cartridge according to the fifth embodiment of the present invention.

In the description of the fifth embodiment, the same parts corresponding to the parts in the first embodiment are represented by the same reference numerals, and detailed description will be omitted.

Though the fifth embodiment is different from the first embodiment in the following points, it has otherwise the same structure as the first embodiment in other points.

As shown in FIG. 23 and FIG. 24, in the developer cartridge Ky of the fifth embodiment, the cylindrical connecting member 14 shown in FIG. 8 and FIG. 11 in conjunction with the first embodiment is omitted and a metallic cylindrical fixing member 25 is provided instead, and the engaging groove forming members 12A2 and the engaging grooves 12A2 of the container body 12 are omitted.

The cylindrical fixing member 25 includes an inner cylindrical potion 25*a* to which the opening 15*c* of the resilient thin wall container 15 is mounted, and an outer cylindrical portion 25*b* formed by bending one end of the inner cylindrical portion 25*a* outward.

In a state in which the opening 15*c* of the resilient thin wall container 15 is mounted and fixed to the inner cylindrical portion 25*a* of the cylindrical fixing member 25, the inner cylindrical portion 25*a* is inserted to the inner peripheral surface of the opening 12A1 of the container body 12 and the outer cylindrical portion 25*b* is fitted on the outer peripheral surface of the opening 12A1, so that the resilient thin wall container 15 is detachably mounted to the container body 12. In other words, the cylindrical fixing member 25 is used as the opening fixing member 25 for fixing the opening 15*c* of the resilient thin wall container 15 to the opening 12A1 of the container body 12.

In this state, developer is filled into the resilient thin wall container 15, and then the cylindrical insertion portion 13*c* of the closing lid 13 is inserted into the opening 12A1 of the container body 12. In this case, the container body 12 and the closing lid 13 are detachably connected by loosely press-fitting the cylindrical insertion portion 13*c* to the inner peripheral surface of the inner cylindrical portion 25*a* of the cylindrical fixing member 25 mounted to the opening 12A1 of the container body 12.

In the developer cartridge Ky according to the fifth embodiment, since the opening 15*c* of the resilient thin wall container 15 is fixed to the opening 12A1 of the container body 12 by the cylindrical fixing member 25, the container body 12 and the resilient thin wall container 15 can easily be disassembled after use by disconnecting the cylindrical fixing member 25 from the container body 12. Since the cylindrical fixing member 25 and the resilient thin wall container 15 are significantly stained and thus are difficult to be washed off, the cylindrical fixing member 25 and the resilient thin wall container 15 are disassembled and are recycled as material for different parts without reusing. However, the container body 12 and other parts are washed and then reused.

Since the resilient thin wall container 15 is broken when the cylindrical fixing member 25 and the resilient thin wall container 15 are disassembled, it is absolutely impossible to reuse it. However, there is a case in which the cylindrical fixing member 25 is in the reusable state. In this case, it is possible to wash and reuse the cylindrical fixing member 25.

Sixth Embodiment

Figure 25:
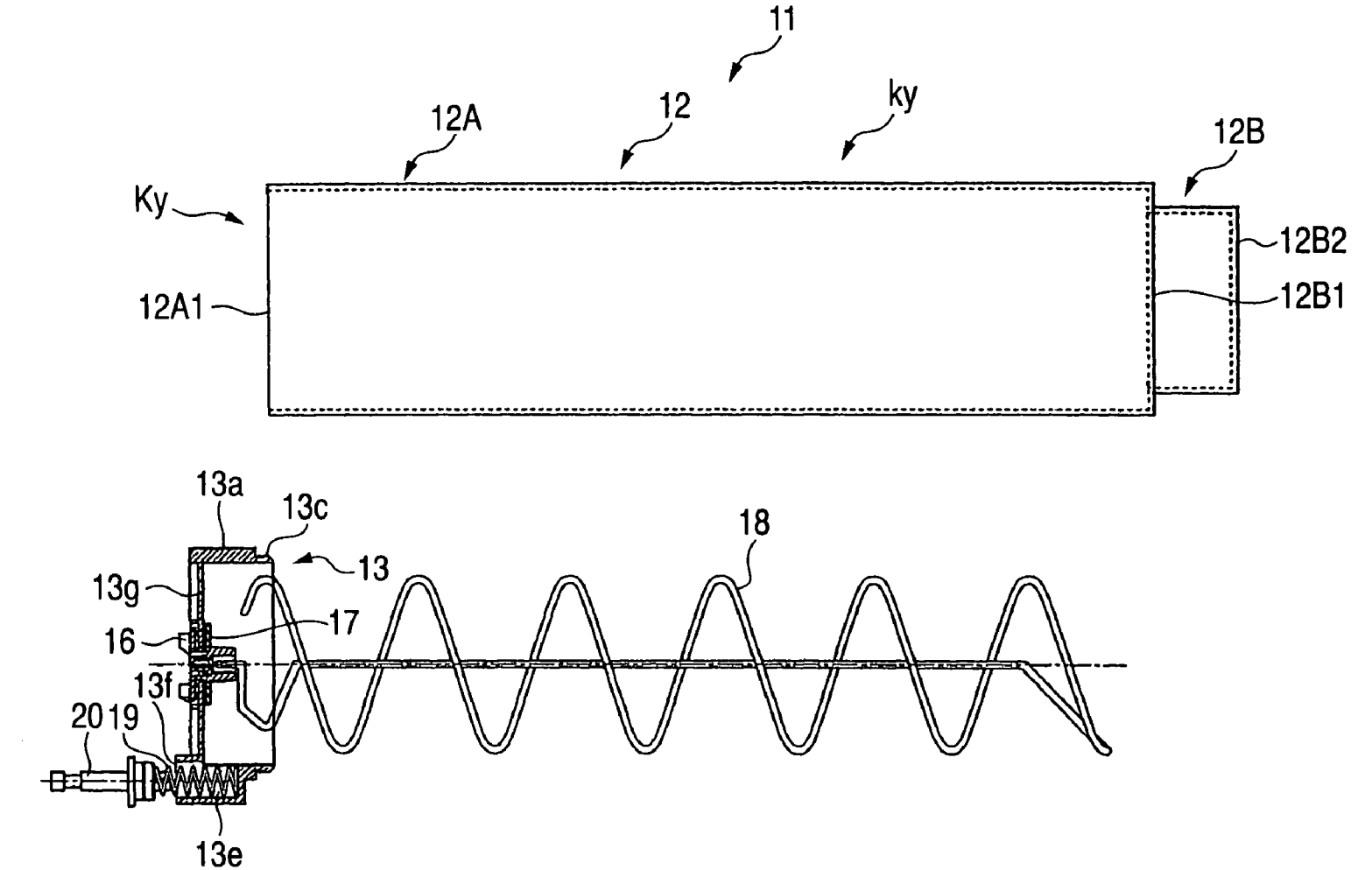
FIG. 25 is an exploded explanatory drawing showing the entire developer cartridge according to the sixth embodiment of the present invention.

FIG. 25 is an exploded explanatory drawing showing the entire developer cartridge according to the sixth embodiment of the present invention.

Figure 26:
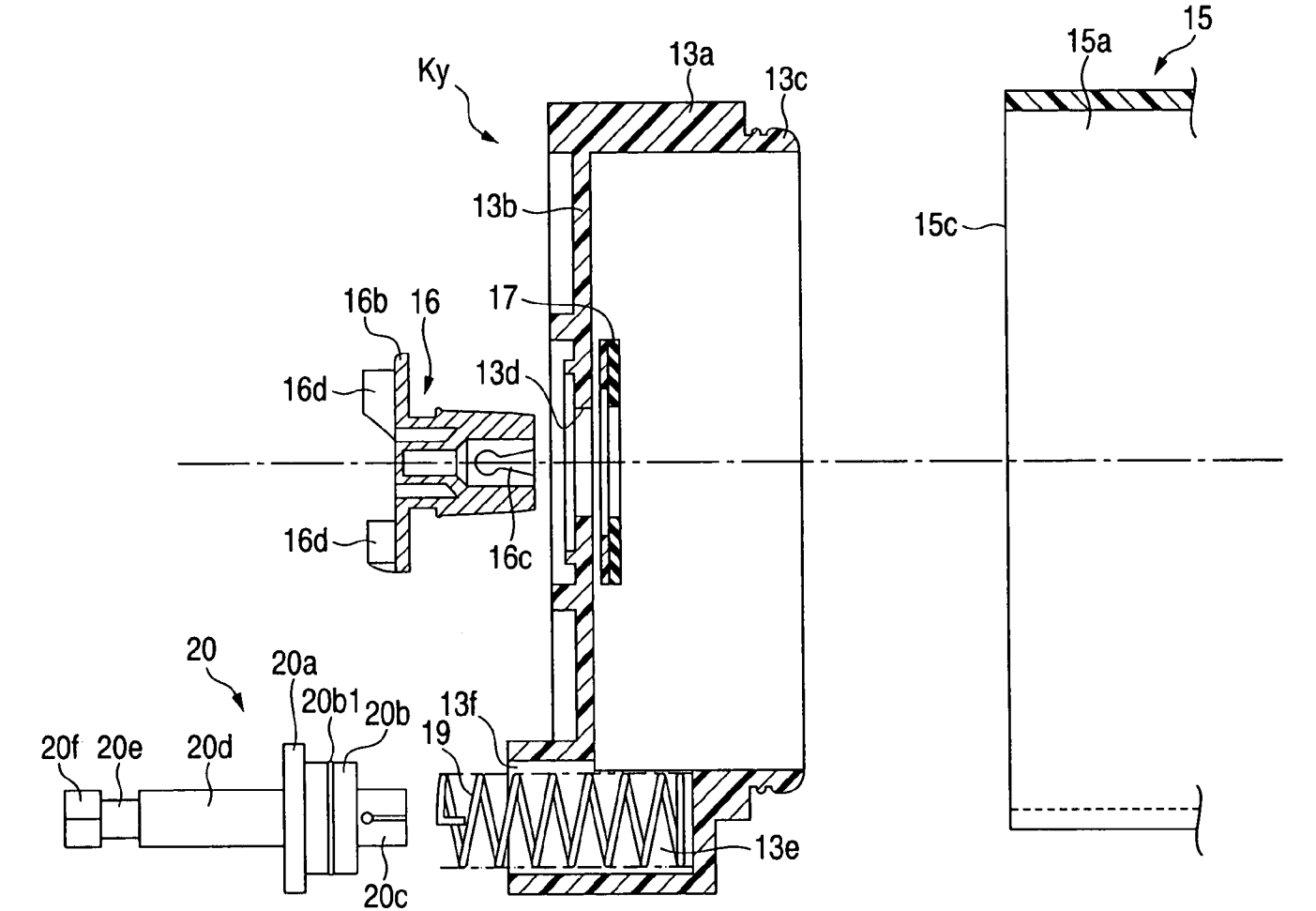
FIG. 26 is an enlarged exploded drawing showing the principal portion of the developer cartridge according to the sixth embodiment of the present invention.

FIG. 26 is an enlarged exploded drawing showing the principal portion of the developer cartridge according to the sixth embodiment of the present invention.

In the description of the sixth embodiment, the same parts corresponding to the parts in the first embodiment are represented by the same reference numerals, and detailed description will be omitted.

Though the sixth embodiment is different from the first embodiment in the following points, it has otherwise the same structure as the first embodiment in other points.

As shown in FIG. 25 and FIG. 26, in the developer cartridge Ky of the sixth embodiment, the cylindrical connecting member 14 and the resilient thin wall container 15 shown in FIG. 8 and FIG. 11 in conjunction with the first embodiment are omitted, and the engaging groove forming members 12A2 and the engaging grooves 12A3 or the container body 22 are omitted. Therefore, in the sixth embodiment, the cylindrical insertion portion 13*c* of the closing lid 13 is directly inserted to the inner peripheral surface of the opening 12A1 of the container body 12. In this case, the container body 12 and the closing lid 13 are detachably connected by loosely press-fitting the cylindrical insertion portion 13*c* to the inner peripheral surface of the opening 12A1 of the container body 12.

As the structure for detachably connecting the container body 12 and the closing lid 13, various structures maybe employed instead of the connecting structure by press-fitting as in the sixth embodiment. For example, the connecting structure by means of a male screw and a female screw, or the connecting structure like the structure in which the engaging grooves 12A3 of the engaging groove forming members 12A2 and the engaging portion (projecting engaging portion) 14*c* of the cylindrical connecting member 14 are connected in the first embodiment way be employed. When employing such connecting structures, the structure in which the cylindrical insertion portion 13*c* is loosely press-fitted to the inner peripheral surface of the opening 12A1 of the container body 12 may be employed together.

In the sixth embodiment, the cylindrical insertion portion 13*c* of the closing lid 13 is inserted into the opening 12A1 of the container body 12 after developer is filled into the container body 12 from the opening 12A1 of the container body 12. In this case, the container body 12 and the closing lid 13 are detachably connected by loosely press-fitting the cylindrical insertion portion 13*c* to the inner peripheral surface of the opening 12A1 of the container body 12.

The developer cartridge Ky in the sixth embodiment, since the opening 12A1 of the container body 12 and the cylindrical insertion portion 13*c* of the closing lid 13 are detachably connected by loosely press-fitting, the container body 12 and the resilient thin wall container 15 may be disassembled easily after use. According to the sixth embodiment, all the parts can be reused after washing.

Seventh Embodiment

Figure 27:
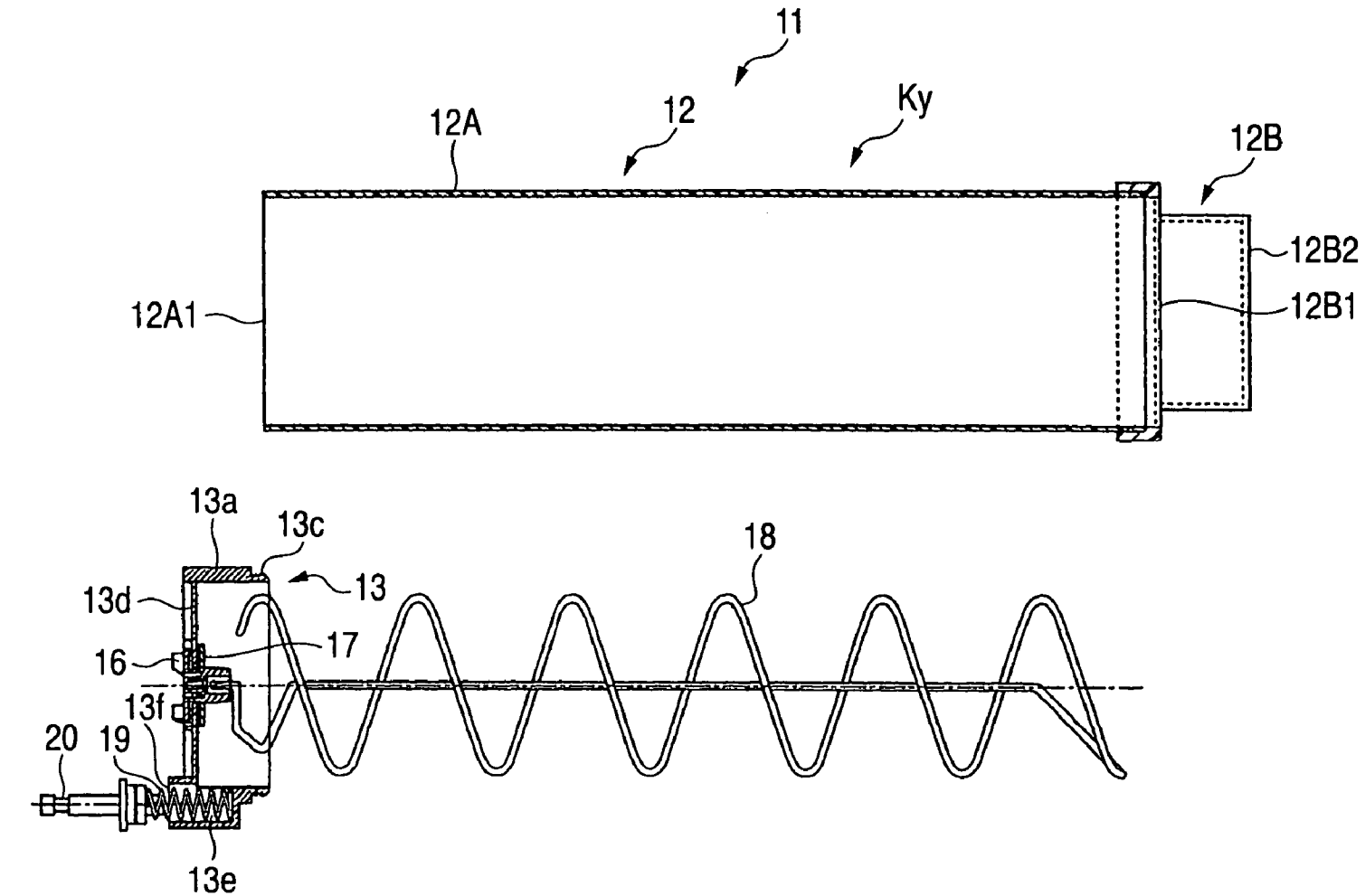
FIG. 27 is an exploded explanatory drawing of the entire developer cartridge according to the seventh embodiment of the present invention.

FIG. 27 is an exploded explanatory drawing of the entire developer cartridge according to the seventh embodiment of the present invention.

In the description of the seventh embodiment, the same parts corresponding to the parts in the first embodiment are represented by the same reference numerals, and detailed description will be omitted.

Though the seventh embodiment is different from the first embodiment in the following points, it has otherwise the same structure as the first embodiment in other points.

As shown in FIG. 27, in the developer cartridge Ky according to the seventh embodiment, the cylindrical connecting member 14 and the resilient thin wall container 15 shown in FIG. 8 and FIG. 11 in conjunction with the first embodiment are omitted, and the engaging groove forming members 12A2 and the engaging grooves 12A3 of the container body 12 are omitted. Therefore, according to the sixth embodiment, the cylindrical insertion portion 13*c* of the closing lid 13 is directly inserted to the inner peripheral surface of the opening 12A1 of the container body 12. In this case, the container body 12 and the closing lid 13 are detachably connected by loosely press-fitting the cylindrical insertion portion 13*c* to the inner peripheral surface of the opening 12A1 of the container body 12.

The container body in the seventh embodiment is divided into halves; the cylindrical wall member 12A and the bottom wall member 12B. The cylindrical member 12A and the bottom wall member 12B are connected by press-fitting.

The detachable connecting structure of the cylindrical wall member 12A and the bottom wall member 12B to be employed may be various connecting structure known in the related art other than the connecting structure by press-fitting. For example, a connecting structure by means of a male screw and a female screw, or the connecting structure using the engaging grooves 12A3 of the engaging groove forming member 12A2 and the engaging portion 14*c* of the cylindrical connecting member 14 in the first embodiment may be employed.

In the seventh embodiment, developer is filled in the container body 12 from the opening 12A1 of the container body 12 in a state in which the cylindrical wall member 12A and the bottom wall member 12B of the container body 12 are connected, and then the cylindrical insertion portion 13*c* of the closing lid 13 are inserted into the opening 12A1 of the container body 12. In this case, the container body 12 and the closing lid 13 are detachable connected by loosely press-fitting the cylindrical insertion portion 13*c* to the inner peripheral surface of the opening 12A1 of the container body 12.

In the developer cartridge Ky of the seventh embodiment, since the opening 12A1 of the container body 12 and the cylindrical insertion portion 13*c* of the closing lid 13 are detachably connected by loosely press-fitting, the container body 12 and the resilient thin wall container 15 can easily be disassembled after use. The cylindrical wall member 12A and the bottom wall member 12B of the container body 12 can also be disassembled. In the seventh embodiment, all the parts may be reused after washing.

Furthermore, since the container body 12 may be divided into the cylindrical wall member 12A and the bottom wall member 12B, they can be washed easily.

(Modification)

Although the embodiments of the invention has been described in detail thus far, the present invention is not limited to the embodiment described above, and various modifications may be implemented within the scope of the present invention stated in the attached claims. An example of modification of the present invention will be shown below.

(H01) In the developer cartridge container of the present invention, developer including only toner, or developer including toner and carrier may be stored.

(H02) In the first embodiment, the engaging groove forming member 12A2 and the engaging portions 14*c* may be omitted, and the cylindrical insertion portion 14*a* of the cylindrical connecting member 14 may be mounted to the opening 12A1 of the cylindrical body 12A by press-fitting. In this case, the cylindrical insertion portion 14*a* also serves as the container-body-side connecting portion.

(H03) One of the container-body-side connecting portions 14*a* and 14*c* and the closing-lid-side connecting member 14*b* of the cylindrical connecting member 14 may be adapted so as to be broken when disassembled after having connected to the container body 12 and the closing lid 13 and thus be unreusable.

(H04) According to the present invention, the coupler 16 and the mixing member 18 for mixing developer in the container body 12 may be omitted so as to be applicable to the developer cartridge adapted in such a manner that the container body can be rotated. The developer cartridge in which the container body is rotated is known in the related art (see JP-A-2002-202.656).

(H05) The technical idea such that when recycling the developer cartridge container 11 after use, the cylindrical connecting member 14 is absolutely broken when disconnecting the cylindrical connecting member 14 from the closing lid 13 so that the developer cartridge Ky cannot be reused without providing a new cylindrical connecting member 14 (new part) may also be applied to the components other than the cylindrical connecting member 14. In this case, since the third party can hardly be able to collect the spent developer cartridge Ky and recycle it for resale, circulation of a number of recycled low-quality developer cartridges Ky in the market may be prevented.

The invention claimed is:

1. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, the developer discharge port is provided at the outer end of the cylindrical wall or an outer peripheral surface of the end wall, wherein the closing lid is formed with a cylindrical developer discharge tube having an axis parallel with an axis of the cylindrical body of the container body; and the developer discharge port is formed at the outer end of the developer discharge tube.

2. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, and the developer discharge port is provided at the outer end of the cylindrical wall or an outer peripheral surface of the end wall, wherein the container body in which the cylindrical body and the bottom wall member are detachably provided.

3. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, the developer discharge port is provided at the outer end of the cylindrical wall or an outer peripheral surface of the end wall, and a handle that is provided on the outer surface of the bottom wall member, wherein the handle and the bottom wall member are integrally formed.

4. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, and the developer discharge port is provided at the outer end of the cylindrical wall or an outer peripheral surface of the end wall, a resilient thin wall container for storing developer formed of resilient thin wall material accommodated in the container body and having an opening to be disposed inside the opening of the container body, and a cylindrical connecting member including container-body-side connecting portions having a cylindrical insertion member to be inserted from the opening of the container body into the container body and to be detachably connected to the container body, and a closing-lid-side connecting portion to be connected to a detachable portion of the closing lid, wherein the resilient thin wall container includes the opening to be fixed in a state of being adhered tightly to the outer peripheral surface of a cylindrical insertion portion of the cylindrical connecting member.

5. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, the developer discharge port is provided at the outer end of the cylindrical wall or an outer peripheral surface of the end wall, and a resilient thin wall container for storing developer formed of resilient thin wall material accommodated in the container body and having an opening to be disposed inside the opening of the container body, wherein the cylindrical connecting member in which a connecting portion of one of the container-body-side connecting portions and the closing-lid-side connecting portion is configured so as to be broken when disconnected after connected to the container body or the closing lid so that it cannot be reused.

6. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, the developer discharge port is provided at the outer end of the cylindrical wall or an outer peripheral surface of the end wall, and a resilient thin wall container for storing developer formed of resilient thin wall material accommodated in the container body and having an opening to be disposed inside the opening of the container body, and a cylindrical wall having a cylindrical insertion portion to be inserted into the container body from the opening of the container body, wherein the resilient thin wall container includes the opening to be attached in a tightly adhered state to the outer peripheral surface of the cylindrical insertion portion; and the closing lid is formed with an openable-closable filling port for filling developer into the resilient thin wall container attached to the cylindrical insertion portion.

7. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, the developer discharge port is provided at the outer end of the cylindrical wall or an outer peripheral surface of the end wall, a resilient thin wall container for storing developer formed of resilient thin wall material accommodated in the container body and having an opening to be disposed inside the opening of the container body, and an opening fixing members for fixing the opening of the resilient thin wall container to the opening of the container body, wherein the resilient thin wall container includes the opening to be attached to the opening of the container body in a tightly adhered state.

8. A developer cartridge container comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber in a state of being attached to the one end of the container body, the closing lid including a detachable portion and a developer discharge port, the detachable portion capable of being attached to and detached from the container body at the one end, wherein the closing lid includes a cylindrical wall provided with the detachable portion, an end wall is connected to an outer end of the cylindrical wall opposite from the container body, the developer discharge port is provided at the outer end of the cylindrical wall or an outer peripheral surface of the end wall, and an opening fixing members for fixing the opening of the resilient thin wall container to the opening of the container body, wherein the resilient thin wall container includes the opening to be attached to the opening of the container body in a tightly adhered state, wherein the opening fixing members is fixed to the opening of the resilient thin wall container.

9. A developer cartridge comprising:

a container body including a cylindrical body having an opening at one end and a bottom wall member provided at the other end opposite from the one end, the cylindrical body and the bottom wall member defining a developer storage chamber having the opening for filling developer at the one end; and a closing lid for closing the opening of the developer storage chamber at the one end in a state of being attached to the container body, the closing lid including a detachable portion capable of being attached to and detached from the container body at the one end, and a developer discharge port formed with the detachable portion;

a coupler for transmitting a rotational force supported by the developer cartridge container;

a developer mixing member accommodated in the developer cartridge container and connected to the coupler; and a discharge port opening-closing member for opening and closing the developer discharge port formed on the developer cartridge container;

wherein the developer discharge port is provided at an outer end of a cylindrical wall or an outer peripheral surface of an end wall of the closing lid.

10. A developer cartridge comprising:

a container body including a cylindrical body having an opening at one end and a bottom wall member provided on the other end opposite from the one end, the cylindrical body and the bottom wall member defining a developer storage chamber having the opening for filling developer at the one end;

a closing lid for closing the opening of the developer storage chamber at the one end in a state of being attached to the container body, the closing lid including a detachable portion capable of being attached to and detached from the container body at the one end, and a cylindrical developer discharge tube extending along an axis of the container body and being formed with a developer discharge port formed with the detachable portion at the outer end thereof;

a coupler for transmitting a rotational force rotatably supported by the closing lid;

a developer mixing member accommodated in the container body and connected to the coupler;

a developer discharging auger rotatably accommodated in the cylindrical developer discharge tube;

a discharge port opening-closing member including a fitting portion to be detachably fitted to the developer discharge port, an auger connecting portion to which the outer end of the developer discharging auger is connected, a shaft projecting outwardly of the developer discharge tube, and a connecting portion for transmitting a rotational force provided at the outer end of the shaft, the discharge port opening-closing member closing the developer discharge port in a state of being fitted to the developer discharge port, opening the developer discharge port in a state of being disconnected from the developer discharge port, and being rotatable integrally with the auger in the detached state.

11. A developer cartridge according to claim 10, wherein the developer discharging auger is formed of a coil spring.

12. A developer cartridge according to claim 10, further comprising:

a resilient thin wall container for storing developer formed of resilient thin wall material detachably accommodated in the container body and having an opening to be disposed inside the opening of the container body.

13. A developer cartridge container comprising:

a container body including a developer storage chamber having an opening at one end;

a closing lid including a cylindrical wall having a cylindrical insertion portion to be inserted from the opening, an end wall connected to the outer end opposite from the cylindrical insertion portion of the cylindrical wall and having a coupler mounting portion and a filling port, and a developer discharge port formed in the cylindrical wall or the end wall, for closing the opening of the developer storage chamber in a state of being attached to the container body, the closing lid closing the opening of the developer storage chamber in a state of being fitted to the container body;

a resilient thin wall container having an opening to be attached to the outer peripheral surface of the cylindrical insertion portion of the cylindrical wall in a tightly adhered state and stored in the container body, wherein the resilient thin wall container is not reused and the container body and the closing lid are washed and reused.

14. A developer cartridge container comprising:

a container body including a developer storage chamber having an opening at one end;

a closing lid including a cylindrical wall, an end wall connected to the cylindrical wall and having a coupler mounting portion, a developer discharge port formed in the end wall or the cylindrical wall, and a detachable portion detachable to the container body;

a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end; and a resilient thin wall container having an opening to be attached to the outer peripheral surface of the cylindrical insertion portion of the cylindrical connecting member in a tightly adhered state and being accommodated into the container body, wherein the resilient thin wall container is not reused and the container body and the closing lid are washed and reused.

15. A developer cartridge container comprising:

a container body including a developer storage chamber having an opening at one end;

a closing lid including a cylindrical wall, an end wall connected to the cylindrical wall and having a coupler mounting portion, a developer discharge port formed in the end wall or the cylindrical wall, and a detachable portion detachable to the container body;

a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end; and a resilient thin wall container having an opening to be attached to the outer peripheral surface of the cylindrical insertion portion of the cylindrical connecting member in a tightly adhered state, being formed of the same material as the cylindrical connecting member, and accommodated in the container body, wherein the spent developer cartridge container is disassembled into the container body, the closing lid, and the cylindrical connecting member to which the resilient thin wall container is mounted, and in that the resilient thin wall container and the cylindrical connecting member are not reused, and the developer cartridge container is formed by assembling a washed container body, a washed closing lid, a new resilient thin wall container, and a new cylindrical connecting member.

16. A developer cartridge container comprising:

a container body including an developer storage chamber having an opening at one end;

a closing lid including a cylindrical wall, an end wall connected to the cylindrical wall and having a coupler mounting portion, a developer discharge port formed in the end wall or the cylindrical wall, and a detachable portion detachable to the container body;

a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end, a connecting portion of one of the container-body-side connecting portion and the closing-lid-side connecting portion being configured so as to be broken when disconnected after connected to the container body or the closing lid so that it cannot be reused; and a resilient thin wall container having an opening to be attached to the outer peripheral surface of the cylindrical insertion portion of the cylindrical connecting member in a tightly adhered state, being formed of the same material as the cylindrical connecting member, and accommodated in the container body, wherein the spent developer cartridge container is disassembled into the container body, a lid member, and the cylindrical connecting member to which the resilient thin wall container is mounted, and in that the cylindrical connecting member and the resilient thin wall container, which are broken when disassembled and hence are disabled, are not reused, and the developer cartridge container is formed by assembling a washed container body, a washed closing lid, a new resilient thin wall container, and a new cylindrical connecting member.

17. A developer cartridge container comprising:

a container body including an developer storage chamber having an opening at one end;

a closing lid including a cylindrical wall, an end wall connected to the cylindrical wall and having a coupler mounting portion, a developer discharge port formed in the end wall or the cylindrical wall, and a detachable portion detachable to the container body;

a cylindrical connecting member including a container-body-side connecting portion having a cylindrical insertion portion to be inserted from the opening of the container body into the container body and being detachably connected to the container body at one end and a closing-lid-side connecting portion being connected to the detachable portion of the closing lid at the other end, a connecting portion of one of the container-body-side connecting portion and the closing-lid-side connecting portion being configured so as to be broken when disconnected after connected to the container body or the closing lid so that it cannot be reused;

a resilient thin wall container having an opening to be attached to the outer peripheral surface of the cylindrical insertion portion of the cylindrical connecting member in a tightly adhered state, being formed of the same material as the cylindrical connecting member, and accommodated in the container body;

a coupler for transmitting a rotational force rotatably supported at the center of the end wall of the closing lid;

a developer mixing member accommodated in the developer cartridge container and connected to the coupler;

a developer discharging auger rotatably accommodated in a cylindrical developer discharge tube;

a discharge port opening-closing member including a fitting portion to be detachably fitted to the developer discharge port, an auger connecting portion to which the outer end of the developer discharging auger is connected, a shaft projecting outwardly of the developer discharge tube, and a connecting portion for transmitting a rotational force provided at the outer end of the shaft, the discharge port opening-closing member closing the developer discharge port in a state of being fitted to the developer discharge port, opening the developer discharge port in a state of being disconnected from the developer discharge port, and being rotatable integrally with the developer auger in the disconnected state, wherein the spent developer cartridge is disassembled into the container body, the closing lid to which the coupler and the developer mixing member are mounted, the discharge port opening-closing member to which the developer discharging auger is connected, and the cylindrical connecting member to which the resilient thin wall container is mounted, and wherein the cylindrical connecting member and the resilient thin wall container, which are broken when disassembled and hence are disabled, are not reused, the container body, the closing lid to which the coupler and the developer mixing member are mounted, and the discharge port opening-closing member to which the auger is connected are washed, and the developer cartridge is formed by assembling the washed container body, closing lid, and discharge port opening-closing member parts with a new cylindrical connecting member and a new resilient thin wall container.

* * * * *